United States Patent [19]

Erdman et al.

[11] Patent Number: 4,927,551

[45] **Date of Patent: * May 22, 1990**

[54] LUBRICATING OIL COMPOSITIONS CONTAINING A COMBINATION OF A MODIFIED SUCCINIMIDE AND A GROUP II METAL OVERBASED SULFURIZED ALKYLPHENOL

[75] Inventors: Timothy R. Erdman; Michael A. Shippey; Robert H. Wollenberg, all of San Rafael, Calif.

[73] Assignee: Chevron Research Company, San Francisco, Calif.

[ * ] Notice: The portion of the term of this patent subsequent to Sep. 16, 2003 has been disclaimed.

[21] Appl. No.: 339,465

[22] Filed: Apr. 14, 1989

Related U.S. Application Data

[63] Continuation of Ser. No. 139,513, Dec. 30, 1987, abandoned, which is a continuation of Ser. No. 921,719, Oct. 21, 1986, abandoned.

[51] Int. Cl.[5] ..... C10M 141/06; C10M 133/44

[52] U.S. Cl. ..... 252/42.7; 252/51.5 A

[58] Field of Search ..... 252/39, 42.7, 51.5 A

[56] References Cited

U.S. PATENT DOCUMENTS

| | | | |
|---|---|---|---|
| 4,196,089 | 4/1980 | Pitzer et al. | 252/42.7 |
| 4,221,673 | 9/1980 | Robson et al. | 252/42.7 |
| 4,612,132 | 9/1986 | Wollenberg et al. | 252/51.5 A |

*Primary Examiner*—Jacqueline V. Howard
*Attorney, Agent, or Firm*—C. J. Caroli; R. C. Gaffney

[57] ABSTRACT

Lubricating oil compositions containing a combination of a polyamino alkenyl or alkyl succinimide modified to contain carbamate functionalities and a Group II metal overbased sulfurized alkylphenol unexpectedly possess little, if any, adverse compatability effects on deposits in diesel engines as compared to lubricating oil compositions containing a combination of an unmodified polyamino alkenyl or alkyl succinimides and a Group II metal overbased sulfurized alkylphenol.

10 Claims, No Drawings

LUBRICATING OIL COMPOSITIONS CONTAINING A COMBINATION OF A MODIFIED SUCCINIMIDE AND A GROUP II METAL OVERBASED SULFURIZED ALKYLPHENOL

This is a continuation of application Ser. No. 138,513, filed Dec. 30, 1987, which is a continuation of Ser. No. 921,719, filed Oct. 21, 1986, both now abandoned.

FIELD OF THE INVENTION

This invention is directed toward lubricating oil compositions containing a combination of a modified succinimide and a Group II metal overbased sulfurized alkylphenol. In particular, the instant invention is directed toward lubricating oil compositions which contain (a) a polyamino alkenyl or alkyl succinimide modified to contain carbamate functionalities; and (b) a Group II metal overbased sulfurized alkylphenol. The combination of the modified succinimide with the Group II metal overbased sulfurized alkylphenol unexpectedly possesses little, if any, adverse compatibility effects on diesel engine deposits as compared to combinations of unmodified polyamino alkenyl or alkyl succinimides with Group II metal overbased sulfurized alkylphenols.

PRIOR ART

Unmodified polyamino alkenyl or alkyl succinimides are well known commercially successful lubricating oil additives which impart detergency/dispersancy to the lubricating oil compositions. When employed in lubricating oil compositions, these additives are used in combination with other additives to provide a fully formulated oil possessing detergency/dispersancy while also providing protection against oxidation, extreme pressure, etc. One type of additive often employed in lubricating oil compositions is a Group II metal overbased sulfurized alkylphenol. This additive imparts antioxidancy, and detergency/dispersancy to the lubricating oil composition as well as providing for an alkalinity reserve in the oil. Alkalinity reserve is necessary in order to neutralize acids generated during engine operation. Without this alkalinity reserve, the acids so generated would result in harmful engine corrosion.

However, there is a problem with the use of a lubricating oil composition containing both a polyamino alkenyl or alkyl succinimide and a Group II metal overbased sulfurized alkylphenol. In particular, this problem involves an adverse compatibility effect on engine deposits in diesel engines which results from using a lubricant composition containing both a polyamino alkenyl or alkyl succinimide and a Group II metal overbased sulfurized alkylphenol. That is to say, in a diesel engine employing a lubricating oil composition containing both a polyamino alkenyl or alkyl succinimide and a Group II metal overbased sulfurized alkylphenol, the dispersancy/detergency resulting from this combination is not additive. In view of the fact that both the polyamino alkenyl or alkyl succinimide and the Group II metal overbased sulfurized alkylphenol possess dispersancy/detergency properties, the lack of expected increase in dispersancy/detergency from this combination as measured by engine deposits is unexpected and is generally attributable to an adverse compatibility effect of the two additives. This problem is sufficiently severe that in some cases a Group II metal overbased natural or synthetic hydrocarbyl sulfonate is employed as the alkalinity agent in lieu of the Group II metal overbased sulfurized alkylphenol in order to avoid this adverse compatibility effect. On the other hand, while these Group II metal overbased natural or synthetic hydrocarbyl sulfonates additionally possess dispersant/detergent properties, these additives do not possess antioxidant properties. Accordingly, it would be particularly desirable to develop a combination of a polyamino alkenyl or alkyl succinimide and a Group II metal overbased sulfurized alkylphenol which would possess compatibility in a lubricating oil composition. Such a combination would represent a clear advantage over prior art combinations of polyamino alkenyl or alkyl succinimides and Group II metal overbased sulfurized alkylphenols.

We have surprisingly found that lubricating oil compositions which contain (a) a polyamino alkenyl or alkyl succinimide modified to contain carbamate functionalities; and (b) a Group II metal overbased sulfurized alkylphenol possess little, if any, adverse compatibility effects on diesel engine deposits. That is to say, the dispersancy/detergency of the combination of the instant invention is generally additive as measured by diesel engine deposits as compared to similar lubricating oil compositions containing one of either a modified polyamino alkenyl or alkyl succinimide or a Group II metal overbased sulfurized alkylphenol.

Prior art references which disclose lubricating oil compositions containing a combination of an unmodified polyamino alkenyl or alkyl succinimide and a Group II metal overbased sulfurized alkylphenol include, for example, U.S. Pat. Nos. 4,495,088 and 4,563,293. However, none of these references teach or suggest that the adverse compatibility effect discussed above can be obviated by employing a polyamino alkenyl or alkyl succinimide modified to contain carbamate functionalities.

SUMMARY OF THE INVENTION

The instant invention is directed toward the discovery that lubricating oil compositions containing (a) a polyamino alkenyl or alkyl succinimide modified to contain carbamate functionalities; and (b) a Group II metal overbased sulfurized alkylphenol unexpectedly possess little, if any, adverse compatibility effects on diesel engine deposits as compared to lubricating oil compositions containing a combination of an unmodified polyamino alkenyl or alkyl succinimide with a Group II metal overbased sulfurized alkylphenol.

The modified polyamino alkenyl or alkyl succinimides useful in the compositions of this invention are polyamino alkenyl or alkyl succinimides wherein one or more of the nitrogens of the polyamino moiety is substituted with a hydrocarbyl oxycarbonyl, a hydroxyhydrocarbyl oxycarbonyl or a hydroxy poly(oxyalkylene)oxycarbonyl group.

Thus, in one aspect, the instant invention is directed toward a lubricating oil composition comprising an oil of lubricating viscosity and (a) from about 0.2 to about 10 percent by weight of a polyamino alkenyl or alkyl succinimide wherein one or more of the nitrogens of the polyamino moiety is substituted with a hydroxyhydrocarbyl oxycarbonyl group wherein the hydroxyhydrocarbyl oxycarbonyl group contains from 2 to 20 carbon atoms and 1 to 6 hydroxy groups with the proviso that there is no hydroxy substitution on the hydrocarbyl carbon atom attaching the hydroxyhydrocarbyl group to the oxy atom of the oxycarbonyl group and with the further proviso that when more than one hydroxy group is contained in the hydroxyhydrocarbyl group, no more than one hydroxy is attached to the same carbon atom and the number of carbon atoms in the hydroxyhydrocarbyl group is minimally one greater than the number of hydroxy groups; and (b) from about 0.5 to about 40 percent by weight of a Group II metal overbased sulfurized alkylphenol.

In another aspect, the instant invention is directed toward a lubricating oil composition comprising an oil of lubricating viscosity and (a) from about 0.2 to about 10 percent by weight of a polyamino alkenyl or alkyl succinimide wherein one or more of the nitrogens of the polyamino moiety is substituted with a hydrocarbyl oxycarbonyl group; and (b) from about 0.5 to about 40 percent by weight of a Group II metal overbased sulfurized alkylphenol.

In still another aspect, the instant invention is directed toward a lubricating oil composition comprising an oil of lubricating viscosity and (a) from about 0.2 to about 10 percent by weight of a polyamino alkenyl or alkyl succinimide wherein one or more of the nitrogens of the polyamino moiety is substituted with a hydroxy poly(oxyalkylene)oxycarbonyl group; and (b) from about 0.5 to about 4 percent by weight of a Group II metal overbased sulfurized alkylphenol.

In yet another aspect, the instant invention is directed toward a lubricating oil composition comprising an oil of lubricating viscosity and (a) from about 0.2 to about 10 percent by weight of a product produced by the process which comprises contacting at a temperature sufficient to cause reaction a polyamino alkenyl or alkyl succinimide containing at least one primary or secondary amine with a cyclic carbonate and wherein the molar charge amino alkenyl or alkyl succinimide is from about 0.2:1 to about 10:1; and from about 0.5 to about 40 percent by weight of a Group II metal overbased sulfurized alkylphenol.

A further aspect of this invention is a lubricating oil composition comprising an oil of lubricating viscosity and (a) from about 0.2 to about 10 percent by weight of a product produced by the process which comprises contacting at a temperature sufficient to cause reaction a polyamino alkenyl or alkyl succinimide containing at least one primary or secondary amine with a linear polycarbonate wherein the molar ratios of the individual carbonate units of said linear polycarbonate to the basic amine of the polyamino alkenyl or alkyl succinimide is from about 0.1:1 to about 5:1; and (b) from about 0.5 to about 40 percent by weight of a Group II metal overbased sulfurized alkylphenol.

In its method aspect, the instant invention is directed toward a method of improving the compatibility of a diesel engine lubricating oil composition containing 0.5 to 40 percent by weight of a Group II metal overbased sulfurized alkylphenol to a polyamino alkenyl or alkyl succinimide which comprises employing from about 0.2 to about 10 percent by weight of a modified polyamino alkenyl or alkyl succinimide selected from the group consisting of a polyamino alkenyl or alkyl succinimides wherein one or more of the nitrogens of the polyamino moiety is substituted with a hydroxyhydrocarbyl oxycarbonyl group wherein the hydroxyhydrocarbyl oxycarbonyl group contains from 2 to 20 carbon atoms and 1 to 6 hydroxy groups with the proviso that there is no hydroxy substitution on the hydrocarbyl carbon atoms attaching the hydroxyhydrocarbyl group to the oxy atom of the oxycarbonyl group and with the further proviso that when more than one hydroxy group is contained in the hydroxyhydrocarbyl group, no more than one hydroxy group is attached to the same carbon atom and the number of carbon atoms in the hydroxyhydrocarbyl group is minimally one greater than the number of hydroxy groups, a polyamino alkenyl or alkyl succinimide wherein one or more of the nitrogens of the polyamino moiety is substituted with a hydrocarbyl oxycarbonyl group, a polyamino alkenyl or alkyl succinimide wherein one or more of the nitrogens of the polyamino moiety is substituted with a hydroxy poly(oxyalkylene) oxycarbonyl group, a product produced by the process which comprises contacting at a temperature sufficient to cause reaction a polyamino alkenyl or alkyl succinimide containing at least one primary or secondary amine with a cyclic carbonate and wherein the molar charge of the cyclic carbonate to the basic nitrogen of the polyamino alkenyl or alkyl succinimide is from about 0.2:1 to about 10:1, and a product produced by the process which comprises contacting at a temperature sufficient to cause reaction a polyamino alkenyl or alkyl succinimide containing at least one primary or secondary amine with a linear polycarbonate wherein the molar ratios of the individual carbonate units of said linear polycarbonate to the basic amine of the polyamino alkenyl or alkyl succinimide is from about 0.1:1 to about 5:1.

DETAILED DESCRIPTION OF THE INVENTION

The lubricating oil compositions and the methods of this invention employ polyamino alkenyl or alkyl succinimides modified to contain carbamate functionalities.

These modified polyamino alkenyl or alkyl succinimides of this invention are prepared from a polyamino alkenyl or alkyl succinimide. In turn, these materials are prepared by reacting an alkenyl or alkyl succinic anhydride with a polyamine as shown in reaction (1) below:

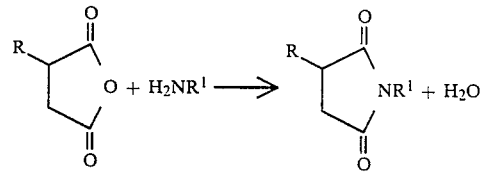

(1)

wherein R is an alkenyl or alkyl group of from 10 to 300 carbon atoms; and $R^1$ is the remainder of the polyamino moiety.

In general, the alkenyl or alkyl group of the succinimide is from 10 to 300 carbon atoms. While the modified succinimides possess good detergency properties even for alkenyl or alkyl groups of less than 20 carbon atoms, dispersancy is enhanced when the alkenyl or alkyl group is at least 20 carbon atoms. Accordingly, in a preferred embodiment, the alkenyl or alkyl group of the succinimide is at least 20 carbon atoms.

These alkenyl or alkyl succinimides that can be used herein are disclosed in numerous references and are well known in the art. Certain fundamental types of succinimides and related materials encompassed by the term of art "succinimide" are taught in U.S. Pat. Nos. 2,992,708; 3,018,291; 3,024,237; 3,100,673; 3,219,666; 3,172,892; and 3,272,746, the disclosures of which are hereby incorporated by reference. The term "succinimide" is understood in the art to include many of the amide, imide and amidine species which are also formed by this reaction. The predominant product however is succinimide and this term has been generally accepted as meaning the product of a reaction of an alkenyl substituted succinic acid or anhydride with a polyamine as shown in reaction (1) above. As used herein, included within this term are the alkenyl or alkyl mono-, bissuccinimides and other higher analogs.

Also included within the term "polyamino alkenyl or alkyl succinimide" are multiple adducted products such as those described in U.S. Pat. No. 4,234,435 which is incorporated herein by reference for its teachings of multiple adducted products.

Succinic Anhydride

The preparation of the alkenyl-substituted succinic anhydride by reaction with a polyolefin and maleic anhydride has been described, e.g., U.S. Pat. Nos. 3,018,250 and 3,024,195. Such methods include the thermal reaction of the polyolefin with maleic anhydride and the reaction of a halogenated polyolefin, such as a chlorinated polyolefin, with maleic anhydride. Reduction of the alkenyl-substituted succinic anhydride yields the corresponding alkyl derivative. Alternatively, the alkenyl substituted succinic anhydride may be prepared as described in U.S. Pat. Nos. 4,388,471 and 4,450,281 which are totally incorporated herein by reference.

Polyolefin polymers for reaction with the maleic anhydride are polymers comprising a major amount of $C_2$ to $C_5$ mono-olefin, e.g., ethylene, propylene, butylene, isobutylene and pentene. The polymers can be homopolymers such as polyisobutylene as well as copolymers of 2 or more such olefins such as copolymers of: ethylene and propylene, butylene, and isobutylene, etc. Other copolymers include those in which a minor amount of the copolymer monomers, e.g., 1 to 20 mole percent is a $C_4$ to $C_8$ nonconjugated diolefin, e.g., a copolymer of isobutylene and butadiene or a copolymer of ethylene, propylene and 1,4-hexadiene, etc.

The polyolefin polymer, the alkenyl or alkyl moiety which is represented as R, usually contains from about 10 to 300 carbon atoms, although preferably 10 to 200 carbon atoms; more preferably 12 to 100 carbon atoms and most preferably 20 to 100 carbon atoms.

A particularly preferred class of olefin polymers comprises the polybutenes, which are prepared by polymerization of one or more of 1-butene, 2-butene and isobutene. Especially desirable are polybutenes containing a substantial proportion of units derived from isobutene. The polybutene may contain minor amounts of butadiene which may or may not be incorporated in the polymer. Most often the isobutene units constitute 80%, preferably at least 90%, of the units in the polymer. These polybutenes are readily available commercial materials well known to those skilled in the art. Disclosures thereof will be found, for example, in U.S. Pat. Nos. 3,215,707; 3,231,587; 3,515,669; and 3,579,450, as well as U.S. Pat. No. 3,912,764. The above are incorporated by reference for their disclosures of suitable polybutenes.

In addition to the reaction of a polyolefin with maleic anhydride, many other alkylating hydrocarbons may likewise be used with maleic anhydride to produce alkenyl succinic anhydride. Other suitable alkylating hydrocarbons include cyclic, linear, branched and internal or alpha olefins with molecular weights in the range 100–4,500 or more with molecular weights in the range of 200–2,000 being more preferred. For example, alpha olefins are obtained from the thermal cracking of paraffin wax. Generally, these olefins range from 5–20 carbon atoms in length. Another source of alpha olefins is the ethylene growth process which gives even number carbon olefins. Another source of olefins is by the dimerization of alpha olefins over an appropriate catalyst such as the well-known Ziegler catalyst. Internal olefins are easily obtained by the isomerization of alpha olefins over a suitable catalyst such as silica.

Also included with the term "alkenyl or alkyl succinic anhydride" are the multiple adducted succinic anhydrides described in U.S. Pat. No. 4,234,435 which is incorporated herein in its entirety. These multiple adducted succinic anhydrides are characterized by the presence within their structure of an average of greater than 1 succinic group per each equivalent of alkenyl or alkyl group and preferably an average from greater than 1 to 3.5 succinic groups for each equivalent of alkenyl or alkyl group (substituent group). More preferably, there are an average from at least 1.3 to 3.5 succinic groups for each equivalent of substituent groups and even more preferably from 1.5 to 3.5 succinic groups for each equivalent of substituent group. The term "equivalent of alkenyl or alkyl group" is used herein rather than "substituent group" as used in U.S. Pat. No. 4,234,435 but as used herein means the same as "substituent group" and is calculated as described in U.S. Pat. No. 4,234,435. In such multiply adducted alkenyl or alkyl succinimides, the alkenyl or alkyl group has from 10 to about 300 carbon atoms, although preferably from 20 to 100 carbon atoms. Another preferred embodiment for such multiply adducted alkenyl or alkyl succinimides are alkenyl or alkyl groups from 70 to 150 carbon atoms.

Polyamine

The polyamine employed to prepare the polyamino alkenyl or alkyl succinimides is preferably polyamine having from 2 to about 12 amine nitrogen atoms and from 2 to about 40 carbon atoms. The polyamine is reacted with an alkenyl or alkyl succinic anhydride to produce the polyamino alkenyl or alkyl succinimide, employed in this invention. The polyamine is so selected so as to provide at least one basic amine per succinimide. Since the reaction of a nitrogen of a polyamino alkenyl or alkyl succinimide to form a hydrocarbyl oxycarbonyl, a hydroxy hydrocarbyl oxycarbonyl or a hydroxy polyoxyalkylene oxycarbonyl is believed to efficiently proceed through a secondary or primary amine, at least one of the basic amine atoms of the polyamino alkenyl or alkyl succinimide must either be a primary amine or a secondary amine. Accordingly, in those instances in which the succinimide contains only one basic amine, that amine must either be a primary amine or a secondary amine. The polyamine preferably has a carbon-to-nitrogen ratio of from about 1:1 to about 10:1.

The polyamine portion of the polyamino alkenyl or alkyl succinimide may be substituted with substituents selected from (A) hydrogen, (B) hydrocarbyl groups of from 1 to about 10 carbon atoms, (C) acyl groups of from 2 to about 10 carbon atoms, and (D) monoketo, monohydroxy, mononitro, monocyano, lower alkyl and lower alkoxy derivatives of (B) and (C). "Lower", as used in terms like lower alkyl or lower alkoxy, means a group containing from 1 to about 6 carbon atoms. At least one of the substituents on one of the amines of the polyamine is hydrogen, e.g., at least one of the basic nitrogen atoms of the polyamine is a primary or secondary amino nitrogen atom.

Hydrocarbyl, as used in describing the polyamine components of this invention, denotes an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylenic and acetylenic, particularly acetylenic unsaturation. The substituted polyamines of the present invention are generally, but not necessarily, N-substituted polyamines. Exemplary hydrocarbyl groups and substituted hydrocarbyl groups include alkyls such as methyl, ethyl, propyl, butyl, isobutyl, pentyl, hexyl, octyl, etc., alkenyls such as propenyl, isobutenyl, hexenyl, octenyl, etc., hydroxyalkyls, such as 2-hydroxyethyl, 3-hydroxypropyl, hydroxyisopropyl, 4-hydroxybutyl, etc., ketoalkyls, such as 2-ketopropyl, 6-ketooctyl, etc., alkoxy and lower alkenoxy alkyls, such as ethoxyethyl, ethoxypropyl, propoxyethyl, propoxypropyl, 2-(2-ethoxyethoxy)ethyl, 2-(2-(2-ethoxyethoxy)ethoxy)ethyl, 3,6,9,12-tetraoxatetradecyl, 2-(2-ethoxyethoxy)hexyl, etc. The acyl groups of the aforementioned (C) substituents are such as propionyl, acetyl, etc. The more preferred substituents are hydrogen, $C_1$–$C_6$ alkyls and $C_1$–$C_6$ hydroxyalkyls.

In a substituted polyamine the substituents are found at any atom capable of receiving them. The substituted atoms, e.g., substituted nitrogen atoms, are generally geometrically inequivalent, and consequently the substituted amines finding use in the present invention can be mixtures of mono- and polysubstituted polyamines with substituent groups situated at equivalent and/or inequivalent atoms.

The more preferred polyamine finding use within the scope of the present invention is a polyalkylene polyamine, including alkylene diamine, and including substituted polyamines, e.g., alkyl substituted polyalkylene polyamine. Preferably, the alkylene group contains from 2 to 6 carbon atoms, there being preferably from 2 to 3 carbon atoms between the nitrogen atoms. Such groups are exemplified by ethylene, 1,2-propylene, 2,2-dimethyl-propylene, trimethylene, etc. Examples of such polyamines include ethylene diamine, diethylene triamine, di(trimethylene)triamine, dipropylene triamine, triethylene tetramine, tripropylene tetramine, tetraethylene pentamine, and pentaethylene hexamine. Such amines encompass isomers such as branched-chain polyamines and the previously mentioned substituted polyamines, including hydrocarbyl-substituted polyamines. Among the polyalkylene polyamines, those containing 2–12 amine nitrogen atoms and 2–24 carbon atoms are especially preferred, and the $C_2$–$C_5$ alkylene polyamines are most preferred, in particular, the lower polyalkylene polyamines, e.g., ethylene diamine, dipropylene triamine, etc.

The polyamine component also may contain heterocyclic polyamines, heterocyclic substituted amines and substituted heterocyclic compounds, wherein the heterocycle comprises one or more 5–6 membered rings containing oxygen and/or nitrogen. Such heterocycles may be saturated or unsaturated and substituted with groups selected from the aforementioned (A), (B), (C) and (D). The heterocycles are exemplified by piperazines, such as 2-methylpiperazine, N-(2-hydroxyethyl)-piperazine, 1,2-bis-(N-piperazinyl)ethane, and N,N'-bis(N-piperazinyl)piperazine, 2-methylimidazoline, 3-aminopiperidine, 2-aminopyridine, 2-(3-aminoethyl)-3-pyrroline, 3-aminopyrrolidine, N-(3-aminopropyl)-morpholine, etc. Among the heterocyclic compounds, the piperazines are preferred.

Typical polyamines that can be used to form the compounds of this invention include the following: ethylene diamine, 1,2-propylene diamine, 1,3-propylene diamine, diethylene triamine, triethylene tetramine, hexamethylene diamine, tetraethylene pentamine, methylaminopropylene diamine, N-(betaaminoethyl)piperazine, N,N'-di(betaaminoethyl)piperazine, N,N'-di(-beta-aminoethyl)imidazolidone-2, N-(beta-cyanoethyl)ethane-1,2-diamine, 1,3,6,9-tetraaminooctadecane, 1,3,6-triamino-9-oxadecane, N-(beta-aminoethyl)diethanolamine, N-methyl-1,2-propanediamine, 2-(2-aminoethylamino)-ethanol, 2-[2-(2-aminoethylamino)ethylamino]-ethanol.

Another group of suitable polyamines are the propyleneamines, (bisaminopropylethylenediamines). Propyleneamines are prepared by the reaction of acrylonitrile with an ethyleneamine, for example, an ethyleneamine having the formula $H_2N(CH_2CH_2NH)_ZH$ wherein Z is an integer from 1 to 5, followed by hydrogenation of the resultant intermediate. Thus, the product prepared from ethylene diamine and acrylonitrile would be $H_2N(CH_2)_3NH(CH_2)_2NH(CH_2)_3NH_2$.

In many instances the polyamine used as a reactant in the production of succinimides of the present invention is not a single compound but a mixture in which one or several compounds predominate with the average composition indicated. For example, tetraethylene pentamine prepared by the polymerization of aziridine or the reaction of dichloroethylene and ammonia will have both lower and higher amine members, e.g., triethylene tetramine, substituted piperazines and pentaethylene hexamine, but the composition will be largely tetraethylene pentamine and the empirical formula of the total amine composition will closely approximate that of tetraethylene pentamine. Finally, in preparing the succinimide for use in this invention, where the various nitrogen atoms of the polyamine are not geometrically equivalent, several substitutional isomers are possible and are encompassed within the final product. Methods of preparation of polyamines and their reactions are detailed in Sidgwick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volumes 2, pp. 99–116.

The reaction of a polyamine with an alkenyl or alkyl succinic anhydride to produce the polyamino alkenyl or alkyl succinimides is well known in the art and is disclosed in U.S. Pat. Nos. 2,992,708; 3,018,291; 3,024,237; 3,100,673; 3,219,666; 3,172,892 and 3,272,746. The above are incorporated herein by reference for their disclosures of preparing alkenyl or alkyl succinimides.

Likewise, the reaction of a polyamine with a multiply adducted alkenyl or alkyl succinic anhydride to form a multiply adducted alkenyl or alkyl succinimide is well-known in the art and is described in U.S. Pat. No. 4,234,435.

As noted above, the term "polyamino alkenyl or alkyl succinimide" refers to both polyamino alkenyl or alkyl mono- and bissuccinimides and to the higher analogs of alkenyl or alkyl poly-succinimides. Preparation of the bis- and higher analogs may be accomplished by controlling the molar ratio of the reagents. For example, a product comprising predominantly mono- or bissuccinimide can be prepared by controlling the molar ratios of the polyamine and succinic anhydride. Thus, if one mole of polyamine is reacted with one mole of an alkenyl or alkyl substituted succinic anhydride, a predominantly monosuccinimide product will be prepared. If two moles of an alkenyl or alkyl substituted succinic anhydride are reacted per mole of polyamine, a bissuccinimide is prepared. Higher analogs may likewise be prepared.

As noted above, the term "multiply adducted alkenyl or alkyl succinimide" refers to the reaction product of a polyamine with a multiply adducted alkenyl or alkyl succinic anhydride which in turn is an alkenyl or alkyl succinic anhydride characterized by the presence within their structure of an average of greater than 1 succinic group for each equivalent of alkenyl or alkyl group (substituent group). As used herein the term "polyamino alkenyl or alkyl succinimides" includes both the multiply adducted alkenyl or alkyl succinimides as well as the "classic" alkenyl or alkyl succinimides, i.e., characterized by the presence within their structure of one succinic group per each alkenyl or alkyl group.

A particularly preferred class of polyamino alkenyl or alkyl succinimides employed in the process of the instant invention may be represented by Formula II:

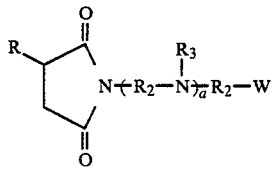

wherein R is alkenyl or alkyl of from 10 to 300 carbon atoms; $R_2$ is alkylene of 2 to 10 carbon atoms; $R_3$ is hydrogen, lower alkyl or lower hydroxy alkyl; a is an integer from 0 to 10; and W is $—NH_2$ or represents a group of Formula III:

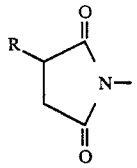

wherein R is alkenyl or alkyl of from 10 to 300 carbon atoms; with the proviso that when W is the group of Formula III above, then a is not zero and at least one of $R_3$ is hydrogen.

As indicated above, the polyamine employed in preparing the succinimide is often a mixture of different compounds having an average composition indicated as the Formula II. Accordingly, in Formula II each value of $R_2$ and $R_3$ may be the same as or different from other $R_2$ and $R_3$.

Preferably R is alkenyl or alkyl of 10 to 200 carbon atoms and most preferably 20 to 100 carbon atoms.

Preferably $R_2$ is alkylene of 2 to 6 carbon atoms and most preferably is either ethylene or propylene.

Preferably, $R_3$ is hydrogen.

Preferably, a is an integer from 1 to 6.

The polyamino alkenyl or alkyl succinimides employed herein may be conveniently viewed as being composed of three moieties. For example, in Formula II the alkenyl or alkyl moiety is represented by R, the succinimide moiety is represented by the formula:

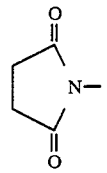

and the polyamino moiety is represented by the group

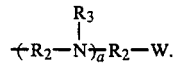

The preferred alkylene polyamines employed in this reaction are generally represented by the formula:

$$H_2NR_2NH)_a—R_2NH_2$$

wherein $R_2$ is an alkylene moiety of 2 to 10 carbon atoms and a is an integer from about 0 to 10. However, the preparation of these alkylene polyamines do not produce a single compound and cyclic heterocycles, such as piperazine, may be included to some extent in the alkylene diamines.

POLYAMINO ALKENYL OR ALKYL SUCCINIMIDES WHEREIN ONE OR MORE OF THE NITROGENS IS SUBSTITUTED WITH HYDROCARBYL OXYCARBONYL, HYDROXY HYDROCARBYL OXYCARBONYL, OR HYDROXY POLY(OXYALKYLENE) OXYCARBONYL

The polyamino alkenyl or alkyl succinimides wherein one or more of the nitrogens of the polyamino moiety is substituted with a hydrocarbyl oxycarbonyl, or a hydroxy hydrocarbyl oxycarbonyl wherein said hydrocarbyl contains from 1 to about 20 carbon atoms and said hydroxy hydrocarbyl contains from 2 to about 20 carbon atoms may be prepared by reaction with a cyclic carbonate; by reaction with a linear mono- or poly-carbonate; or by reaction with a suitable chloroformate. Hydroxy poly(oxyalkylene) oxycarbonyl may be formed by reaction with a suitable chloroformate. The products so produced are effective dispersant and detergent additives for lubricating oils and for fuel.

Hydrocarbyl, as used in describing the hydrocarbyl oxycarbonyl components of this invention, denotes an organic radical composed of carbon and hydrogen which may be aliphatic, aromatic or combinations thereof, e.g., aralkyl. The hydrocarbyl group contains from about 1 to carbon atoms, preferably 2 to 10 carbon atoms and most preferably 2 to 7 carbon atoms. Suitable hydrocarbyls are alkyls such as methyl, ethyl, propyl, butyl, isobutyl, pentyl, hexyl, octyl, etc.; alkenyls such as propenyl, isobutenyl, hexenyl, octenyl, etc.; aralkyl such as benzyl, and the like; aryls such as phenyl, naphthyl, and the like.

Hydroxy substituted hydrocarbyl, as used in describing the hydroxy hydrocarbyl oxycarbonyl components of this invention, denotes an organic radical composed of carbon and hydrogen containing 1 to 6 hydroxy groups, preferably 1 to 3, more preferably 1 to 2 hydroxy groups and most preferably 1 hydroxy group. It is also possible that some keto and aldehyde groups may be present in these hydroxy substituted hydrocarbyls. In the preferred embodiment the hydroxy hydrocarbyl does not contain ketone or aldehyde groups. The hydroxy substituted hydrocarbyl group contains from 2 to 20 carbon atoms, preferably 2 to 10 carbon atoms and most preferably 2 to 7 carbon atoms. Suitable hydroxy hydrocarbyls are hydroxy alkyls such as 2-hydroxyethyl, 3-hydroxypropyl, hydroxyisopropyl, 4-hydroxybutyl, 6-hydroxyhexyl, 2,3-dihydroxypropyl and the like. Some hydroxy alkyls may also be termed "hydroxyalkylene" such as 3-hydroxypropylene ($HOCH_2CH_2CH_2$—) and are included within the term hydroxy alkyls defined above. Other suitable hydroxyhydrocarbyls are hydroxy aralkyls such as 3-hydroxy-2-phenylpropyl

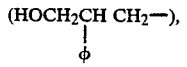

1-hydroxy-4,4'-diphenylene dimethylmethane

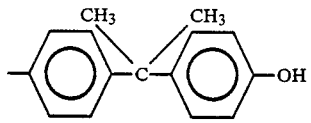

and the like.

Hydroxy poly(oxyalkylene), as used in describing i0 the hydroxy poly(oxyalkylene) oxycarbonyl components of this invention, denotes a polymer containing from 2 to 30 $C_{2-C5}$ oxyalkylene units and may be represented by the formula:

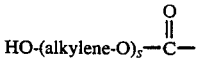

wherein alkylene is a $C_{2-C5}$ alkylene group and s is an integer from 2 to 30.

Cyclic Carbonates

The polyamino alkenyl or alkyl succinimide wherein one or more of the nitrogens of the succinimide is substituted with a hydroxy hydrocarbyl oxycarbonyl may be prepared by reaction of a polyamino alkenyl or alkyl succinimide with a cyclic carbonate. This reaction is conducted at a temperature sufficient to cause reaction of the cyclic carbonate with the polyamino alkenyl or alkyl succinimide. In particular, reaction temperatures of from about 0° C. to about 250° C. are preferred with temperatures of from about 100° C. to 200° C. being more preferred and temperatures of from 150° to 180° C. are most preferred.

The reaction may be conducted neat—that is, both the alkenyl or alkyl succinimide and the cyclic carbonate are combined in the proper ratio, either alone or in the presence of a catalyst, such as an acidic, basic or Lewis acid catalyst, and then stirred at the reaction temperature. Examples of suitable catalysts include, for instance, phosphoric acid, boron trifluoride, alkyl or aryl sulfonic acid, alkali or alkaline carbonate.

Alternatively, the reaction may be conducted in a diluent. For example, the reactants may be combined in a solvent such as toluene, xylene, oil or the like, and then stirred at the reaction temperature. After reaction completion, volatile components may be stripped off. When a diluent is employed, it is preferably inert to the reactants and products formed and is generally used in an amount sufficient to insure efficient stirring.

Water, which can be present in the polyamino alkenyl or alkyl succinimide, may be removed from the reaction system either before or during the course of the reaction via azeotroping or distillation. After reaction completion, the system can be stripped at elevated temperatures (100° C. to 250° C.) and reduced pressures to remove any volatile components which may be present in the product.

Another embodiment of the above process is a continuous system in which the alkenyl or alkyl succinic anhydride and polyamine are added at the front end of the system while the cyclic carbonate is added further downstream in the system.

In such a continuous system, the cyclic carbonate may be added at any time after mixing of the alkenyl or alkyl succinic anhydride with the polyamine has occurred. Preferably, the cyclic carbonate is added within two hours after mixing of the alkenyl or alkyl succinic anhydride with the polyamine, preferably after the major portion of the amine has reacted with the anhydride.

In a continuous system, the reaction temperature may be adjusted to maximize reaction efficiency. Accordingly, the temperature employed in the reaction of the alkyl or alkenyl succinic anhydride with a polyamine may be the same as or different from that which is maintained for the reaction of this resulting product with the cyclic carbonate. In such a continuous system, the reaction temperature is generally between 0°-250° C.; preferably between 125°-200° C.; and most preferably between 150°-180° C. Thus, another aspect of the instant invention is a continuous process which comprises (a) contacting at a temperature sufficient to cause reaction an alkenyl or alkyl succinic anhydride with a polyamine; and (b) then contacting at a temperature sufficient to cause reaction the product of (a) above with a cyclic carbonate.

Mole ratios of the cyclic carbonate to the basic amine nitrogen of the polyamino alkenyl or alkyl succinimide employed in the process of this invention are generally in the range of from about 0.2:1 to about 10:1; although preferably from about 0.5:1 to about 5:1; more preferably from about 1:1 to 3:1 another preferred embodiment is 2:1.

The reaction is generally complete from with 0.5 to 10 hours.

Preferred cyclic carbonates include:

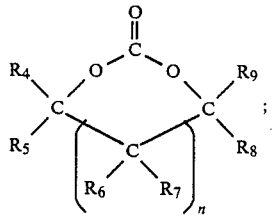

(1)

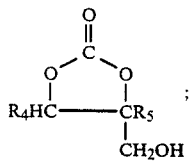

(2)

-continued (3)

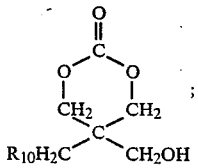

;

(4)

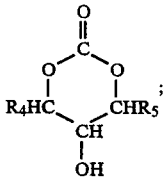

;

and (5)

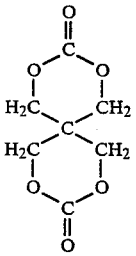

wherein $R_4$, $R_5$, $R_6$, $R_7$, $R_8$ and $R_9$ are independently selected from hydrogen or lower alkyl of 1 to 2 carbon atoms; $R_{10}$ is either hydrogen or hydroxy; and n is an integer from 0 to 1.

Preferred cyclic carbonates for use in this invention are those of formula 1 above. Preferred $R_4$, $R_5$, $R_6$, $R_7$, $R_8$ and $R_9$ are either hydrogen or methyl. Most preferably $R_4$, $R_5$, $R_6$, $R_7$, $R_8$ and $R_9$ are hydrogen when n is one. $R_8$ is most preferably hydrogen or methyl while $R_4$, $R_5$, and $R_9$ are hydrogen when n is zero.

The following are examples of suitable cyclic carbonates for use in this invention: 1,3-dioxolan-2-one(ethylene carbonate); 4-methyl-1,3-dioxolan-2-one(propylene carbonate); 4-hydroxymethyl-1,3-dioxolan-2-one; 4,5-dimethyl-1,3-dioxolan-2-one; 4-ethyl-1,3-dioxolan-2-one; 4,4-dimethyl-1,3-dioxolan-2-one; 4-methyl-5-ethyl-1,3-dioxolan-2-one; 4,5-diethyl-1,3-dioxolan-2-one; 4,4-diethyl-1,3-dioxolan-2-one; 1,3-dioxan-2-one; 4,4-dimethyl-1,3-dioxan-2-one; 5,5-dimethyl-1,3-dioxan-2-one; 5,5-dihydroxymethyl-1,3-dioxan-2-one; 5-methyl-1,3-dioxan-2-one; 4-methyl-1,3-dioxan-2-one; 5-hydroxy-1,3-dioxan-2-one; 5-hydroxymethyl-5-methyl-1,3-dioxan-2-one; 5,5-diethyl-1,3-dioxan-2-one; 5-methyl-5-propyl-1,3-dioxan-2-one; 4,6-dimethyl-1,3-dioxan-2-one; 4,4,6-trimethyl-1,3-dioxan-2-one and spiro[1,3-oxa-2-cyclohexanone-5,5'-1',3'-oxa-2'-cyclohexanone]. Other suitable cyclic carbonates may be prepared from sacchrides such as sorbitol, glucose, fructose, galactose and the like and from visconal diols prepared from $C_1$–$C_{30}$ olefins by methods known in the art.

Several of these cyclic carbonates are commercially available such as 1,3-dioxolan-2-one or 4-methyl-1,3-dioxolan-2-one. Cyclic carbonates may be readily prepared by known reactions. For example, reaction of phosgene with a suitable alpha alkane diol or an alkan-1,3-diol yields a carbonate for use within the scope of this invention as for instance in U.S. Pat. No. 4,115,206 which is incorporated herein by reference.

Likewise, the cyclic carbonates useful for this invention may be prepared by transesterification of a suitable alpha alkane diol or an alkan-1,3-diol with, e.g., diethyl carbonate under transesterification conditions. See, for instance, U.S. Pat. Nos. 4,384,115 and 4,423,205 which are incorporated herein by reference for their teaching of the preparation of cyclic carbonates.

As used herein, the term "alpha alkane diol" means an alkane group having two hydroxyl substituents wherein the hydroxyl substituents are on adjacent carbons to each other. Examples of alpha alkane diols include 1,2-propanediol, 2,3-butanediol and the like.

The term "alkan-1,3-diol" means an alkane group having two hydroxyl substituents wherein the hydroxyl substituents are beta substituted. That is, there is a methylene or a substituted methylene moiety between the hydroxyl substituted carbons. Examples of alkan-1,3-diols include propan-1,3-diol, pentan-2,4-diol and the like.

As used herein, the term "hydroxy hydrocarbyl oxycarbonyl" refers to the group hydroxy hydrocarbyl-O$\overset{O}{\overset{\|}{C}}$—; the term "hydrocarbyloxy carbonyl" refers to the group hydrocarbyl-O$\overset{O}{\overset{\|}{C}}$—; and the term "hydroxy poly(oxyalkylene) oxycarbonyl" refers to the group HO-(alkylene-O)$_5$-$\overset{O}{\overset{\|}{C}}$—.

As used herein, the term "spiro[1,3-oxa-2-cyclohexanone-5,5'-1',3'-oxa-2'cyclohexanone]" means

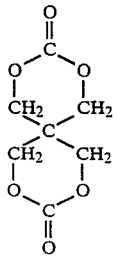

As used herein, the term "molar charge of cyclic carbonate (or chloroformate or linear carbonate) to the basic nitrogen of a polyamino alkenyl or alkylsuccinimide" means that the molar charge of cyclic carbonate (or chloroformate or linear carbonate) employed in the reaction is based upon the theoretical number of basic nitrogens contained in the succinimide. Thus, when 1 equivalent of triethylene tetraamine (TETA) is reacted with an equivalent of succinic anhydride, the resulting monosuccinimide will theoretically contain 3 basic nitrogens. Accordingly, a molar charge of 1 would require that a mole of cyclic carbonate (or chloroformate or linear carbonate) be added for each basic nitrogen or in this case 3 moles of cyclic carbonate for each mole of monosuccinimide prepared from TETA.

The alpha alkane diols, used to prepare the 1,3-dioxolan-2-ones employed in this invention, are either commercially available or may be prepared from the corresponding olefin by methods known in the art. For example, the olefin may first react with a peracid, such as peroxyacetic acid or hydrogen peroxide to form the corresponding epoxide which is readily hydrolyzed under acid or base catalysis to the alpha alkane diol. In another process, the olefin is first halogenated to a dihalo derivative and subsequently hydrolyzed to an alpha alkane diol by reaction first with sodium acetate and then with sodium hydroxide. The olefins so employed are known in the art.

The alkan-1,3-diols, used to prepare the 1,3-dioxan-2-ones employed in this invention, are either commercially available or may be prepared by standard techniques, e.g., derivatizing malonic acid.

4-Hydroxymethyl 1,3-dioxolan-2-one derivatives and 5-hydroxy-1,3-dioxan-2-one derivatives may be prepared by employing glycerol or substituted glycerol in the process of U.S. Pat. No. 4,115,206. The mixture so prepared may be separated, if desired, by conventional techniques. Preferably the mixture is used as is.

5,5-Dihydroxymethyl-1,3-dioxan-2-one may be prepared by reacting an equivalent of pentaerythritol with an equivalent of either phosgene or diethylcarbonate (or the like) under transesterification conditions.

5-hydroxymethyl-5-methyl-1,3-dioxan-2-one may be prepared by reacting an equivalent of trimethylolethane with an equivalent of either phosgene or diethylcarbonate (or the like) under transesterification conditions.

Spiro[1,3-oxa-2-cyclohexanone-5,5'-1',3'-oxa-2'-cyclohexanone]may be prepared by reacting an equivalent of pentaerythritol with two equivalents of either phosgene or diethylcarbonate (or the like) under transesterification conditions.

Cyclic carbonates of Formula I are used to illustrate the reaction of a cyclic carbonate with a polyamino alkenyl or alkyl succinimide. It is to be understood that the other cyclic carbonates employed in this invention react similarly. Cyclic carbonates may react with the primary and secondary amines of a polyamino alkenyl or alkyl succinimide to form two types of compounds. In the first instance, strong bases, including unhindered amines such as primary amines and some secondary amines, react with an equivalent of cyclic carbonate to produce a carbamic ester as shown in reaction (2) below:

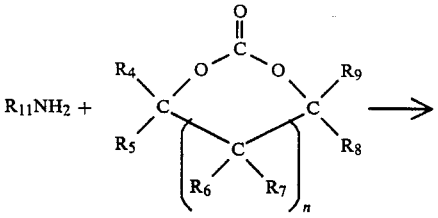

IV I $R_{11}NHC(O)OCR_4R_5(CR_6R_7)_nCR_8R_9OH$

V wherein $R_4$, $R_5$, $R_6$, $R_7$, $R_8$, $R_9$ and n are as defined above and $R_{11}$ is the remainder of a polyamino alkenyl or alkyl succinimide. In this reaction, the amine nitrogen has been rendered nonbasic by formation of the carbamate, V.

In the second instance, hindered bases, such as hindered secondary amines, may react with an equivalent of the same cyclic carbonate to form a hydroxyalkyleneamine linkage with the concomitant elimination of $CO_2$ as shown below in reaction (3):

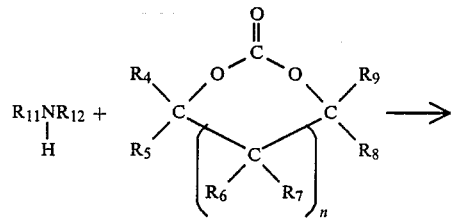

VI $R_{11}R_{12}NCR_4R_5(CR_6R_7)_nCR_8R_9OH + CO_2$

VII wherein $R_4$, $R_5$, $R_6$, $R_7$, $R_8$, $R_9$, $R_{11}$ and n are as defined above and $R_{12}$ is an alkyl or alkylene linking group which hinders the amine. Unlike the carbamate products of reaction (2), the hydroxyalkyleneamine products of reaction (3) retain their basicity. These hydroxyalkyleneamine derivatives, VII, (when n=0) are believed to be similar to those which are produced by the addition to an alkenyl or alkyl succinimide of a substituted ethylene oxide of the formula:

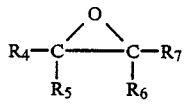

VIII wherein $R_4$, $R_5$, $R_6$ and $R_7$ are as defined above. (See for instance U.S. Pat. Nos. 3,367,943 and 3,377,111).

In theory, if only primary and secondary amines are employed in the polyamine moiety of the succinimide a determination of whether the carbonate addition follows reaction (2) or reaction (3) could be made by monitoring the AV (alkalinity value or alkalinity number—refers to the amount of base as milligrams of KOH in 1 gram of a sample) of the product. Accordingly, if the reaction proceeded entirely via reaction (2) above, a reaction product prepared by reacting an equivalent of carbonate for each basic nitrogen should yield an AV of zero. That is to say that all the basic amines in the polyamine moiety have been converted to nonbasic carbamates.

However, as previously noted, alkylene polyamines such as triethylene tetraamine and tetraethylene pentamine (e.g., tetraethylenepentaamine-TEPA and triethylenetetramine-TETA), contain tertiary amines (piperazines, etc.) which may account for as much as 30% of the basic nitrogen content. Although Applicant does not want to be limited to any theory, it is believed that these tertiary amines, although basic, are not reactive with the carbonate. Accordingly, even if the reaction proceeded entirely by reaction (2) above, an AV of approximately 30% of the original AV may be retained in the final product. Nevertheless, a large drop in the AV of the product is significant evidence that a substantial portion of the reaction product contains carbamic esters.

In fact, the addition of approximately one equivalent of ethylene carbonate for each basic nitrogen appreciably lowers the AV for the monosuccinimide (1), for the bissuccinimide (2), and for the monosuccinimide (3). This indicates that a substantial portion of the first equivalent of ethylene carbonate is adding to the succinimide via reaction (2) yielding hydroxy hydrocarbyl carbamic esters.

1. Succinimide (1) is the product obtained from the reaction of triethylenetetramine (TETA) and polyisobutenyl succinic anhydride (average MW=1050) wherein the molar charge of TETA to the polyisobutenyl succinic anhydride is 0.90. Diluent oil is then added to obtain a concentration of approximately 50 percent actives.

2. Succinimide (2) is the product obtained from the reaction of tetraethylene pentamine (TEPA) and polyisobutenyl succinic anhydride (Average MW=1050). The molar charge of TEPA to the polyisobutenylsuccinic anhydride is 0.5 which gives a bissuccinimide. Diluent oil is then added to obtain a concentration of approximately 50 percent actives.

3. Succinimide (3) is the reaction product obtained from tetraethylene pentamine (TEPA) and polyisobutenyl succinic anhydride (Average MW=1050). The molar charge of TEPA to the polyisobutenyl succinic anhydride is 0.87 which gives a monosuccinimide. Diluent oil is then added to obtain a concentration of approximately 50 percent actives.

On the other hand, the addition of a second equivalent of ethylene carbonate in these reactions does not result in appreciably further lowering of the AV. This suggests that the additional carbonate either reacts via reaction (3) above, if reactive amino nitrogen is available, to form hydroxyalkyleneamine groups or are reacting with the hydroxyl group of the carbamate as shown in reaction 4(a) below:

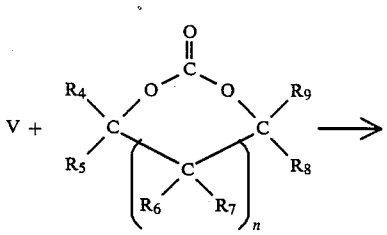

(4a)

I $$R_{11}HNC(O)OCR_4R_5(CR_6R_7)_nCR_8R_9OCR_4R_5(CR_6R_7)_nCR_8R_9OH + CO_2$$

IX wherein $R_4$, $R_5$, $R_6$, $R_7$, $R_8$, $R_9$, $R_{11}$ and n are as defined above.

The process of reaction 4(a) allows for additional carbonate to add to the hydroxyl group of product IX to form a hydroxy tri(oxyalkylene) carbamate as shown in reaction 4(b) below:

$$IX + I \longrightarrow R_{11}NHC(O)[OCR_4R_5(CR_6R_7)_nCR_8R_9]_2OCR_4R_5(CR_6R_7)_nCR_8R_9OH + CO_2 \quad (4b)$$

X wherein $R_4$, $R_5$, $R_6$, $R_7$, $R_8$, $R_9$ and $R_{11}$ are as defined above. As is apparent from the above reaction, the poly(oxyalkylene) portion of the carbamate can be repeated several times, generally up to 10 times or more, simply by addition of more carbonate to form a hydroxy poly(oxyalkylene) carbamate.

Likewise, additional equivalents of carbonate could equally add to the hydroxyl group of the hydroxyalkyleneamine derivative, VII, of reaction (3) as shown in reaction (5) below:

$$VII + I \longrightarrow R_{11}R_{12}N[CR_4R_5(CR_6R_7)_nCR_8R_9O]_2H \quad (5)$$

XI wherein $R_4$, $R_5$, $R_6$, $R_7$, $R_8$, $R_9$, $R_{11}$ and $R_{12}$ are as defined above. Repeating the process of reaction (5) above by the addition of increasing amounts of carbonate produces a hydroxyalkylenepoly(oxyalkylene)amine derivative of Formula XII below:

$$R_{11}R_{12}N[CR_4R_5(CR_6R_7O)_nCR_8R_9]_yH \quad XII$$

wherein $R_4$, $R_5$, $R_6$, $R_7$, $R_8$, $R_9$, $R_{11}$ and $R_{12}$ and n are as defined above and y is an integer from 3 to 10.

It is also contemplated that reactions (4) and (5) above may also produce acyclic carbonate linkages with the terminal hydroxyl group. Likewise, if $R_{11}$ (or $R_{12}$) is hydrogen, then an additional hydroxyalkylene could add to the amino group.

Accordingly, it is expected that the reaction of a cyclic carbonate with a polyamino alkenyl or alkyl succinimide will yield a mixture of products. When the molar charge of the cyclic carbonate to the basic nitrogen of the succinimide is about 1 or less, it is anticipated that a large portion of the primary and secondary amines of the succinimide will have been converted to hydroxy hydrocarbyl carbamic esters with some hydroxyhydrocarbylamine derivatives also being formed. As the mole ratio is raised above 1, poly(oxyalkylene) polymers of the carbamic esters and the hydroxyhydrocarbylamine derivatives are expected.

It is expected that use of the spiro[1,3-oxa-2-cyclohexanone-5,5'-1',3'-oxa-2'-cyclohexanone]may yield internally cyclized products and also bring about crosslinking between two succinimides.

In some instances, it may be desirable to increase the proportion of carbamic esters formed in these reactions. This may be accomplished by changing reaction conditions such as temperature or the rate of addition of cyclic carbonate, etc. or employing a polyamine with a large percentage of primary amine. Another method may be to employ alkylsubstituted (i.e., one or more of $R_1$, $R_2$, $R_3$, $R_4$, $R_5$, or $R_6$ is alkyl) or hydroxyalkyl substituted carbonates. Still another method would be to employ a 6-membered ring cyclic carbonate.

Linear Mono- or Polycarbonates

Linear carbonates react with a basic nitrogen of a polyamino alkenyl or alkyl succinimide to form carbamates. Suitable linear carbonates include both monocarbonates of formula XIII and polycarbonates of formula XIV:

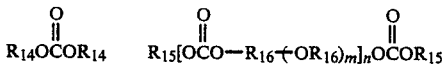

XIII XIV wherein $R_{14}$ is independently hydrocarbyl of from 1 to about 20 carbon atoms; $R_{15}$ is hydroxy hydrocarbyl of from 2 to 20 carbon atoms; $R_{16}$ is a divalent hydrocarbyl group of from 2 to 20 carbon atoms, m is an integer from 0 to 10 or more; n is an integer of from 1 to 200.

Preferably $R_{14}$ is hydrocarbyl of from 1 to 10 carbon atoms; $R_{15}$ is hydroxy hydrocarbyl of from 2 to 10 carbon atoms; $R_{16}$ is a divalent hydrocarbyl of from 2 to 10 carbon atoms; and n is preferably an integer from 1 to 100 and most preferably 1 to 10.

Monocarbonates, XIII, are believed to react with primary or secondary amines of a polyamino alkenyl or alkyl succinimide, with the concommittant elimination of the alcohol, $R_{14}OH$, as shown in reaction (6) below:

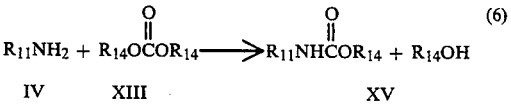

(6)

IV XIII XV wherein $R_{11}$ and $R_{14}$ are as defined above.

Reaction (6) is conducted by contacting the monocarbonate with a polyamino alkenyl or alkyl succinimide. The reaction is conducted at a temperature sufficient to cause reaction of the monocarbonate with the polyamino alkenyl or alkyl succinimide. In particular, reaction temperatures of from about 100° C. to about 250° C. are preferred with temperatures of from about 150° C. to 250° C. being most preferred.

The reaction may be conducted neat—that is, both the polyamino alkenyl or alkyl succinimide and the carbonate are combined in the proper ratio, either alone or in the presence of a catalyst, such as an acidic, basic or Lewis acid catalyst, and then stirred at the reaction temperature. Examples of suitable catalysts include, for instance, phosphoric acid, boron trifluoride, alkyl or aryl sulfonic acid, alkali or alkaline carbonate.

Alternatively, the reaction may be conducted in a diluent. For example, the reactants may be combined in a solvent such as toluene, xylene, oil or the like, and then stirred at the reaction temperature. After reaction completion, volatile components may be stripped off. When a diluent is employed, it is preferably inert to the reactants and products formed and is generally used in an amount sufficient to insure efficient stirring.

Water, which can be present in the polyamino alkenyl or alkyl succinimide, may be removed from the reaction system either before or during the course of the reaction via azeotroping or distillation. After reaction completion, the system can be stripped at elevated temperatures (100° C. to 250° C.) and reduced pressures to remove any volatile components which may be present in the product.

Another embodiment of the above process is a continuous flow system in which the alkenyl or alkyl succinic anhydride and polyamine are added at the front end of the flow while the hydrocarbyl carbonate is added further downstream in the system.

Mole ratios of the hydrocarbyl carbonate to the basic amine nitrogen of the polyamino alkenyl or alkyl succinimide employed in this process are generally in the range of from about 0.2:1 to about 1:1; preferably 0.5:1 to about 1:1 and most preferably 0.7:1 to about 1:1.

The reaction is generally complete from within 0.5 to 10 hours.

Suitable monocarbonates, XIII, may be prepared by transesterifying diethyl carbonate or a similar material using conditions well known in the art. Suitable monocarbonates include dimethyl carbonate, diethyl carbonate, di-n-propyl carbonate, diisopropylcarbonate, diphenyl carbonate, di-n-butyl carbonate, dibenzyl carbonate, and the like.

Linear polycarbonates are of the general formula:

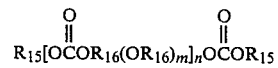

XIV wherein $R_{15}$, $R_{16}$, m and n as defined above. These polycarbonates react with a primary or secondary amine of the polyamino alkenyl or alkyl succinimide to form a carbamate as shown in reaction (7) below wherein for the sake of illustration m is limited to 0:

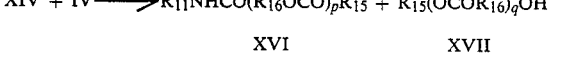

(7)

XIV XVI XVII wherein $R_{11}$, $R_{15}$ and $R_{16}$ are as defined above and p and q are integers such that p+q=n. Further reaction of the polycarbonate, with another primary or secondary amine of the polyamino alkenyl or alkyl succinimide will split off additional units of carbonate from either XVI or XVII. Accordingly, continued reaction of the polycarbonate with the polyamino alkenyl or alkyl succinimide reduces the size of the polycarbonate until either no additional reactive amine nitrogens are available to react with the carbonate or each carbonate unit of the polycarbonate has been reacted with a primary or secondary amine to form a compound of the formula:

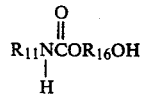

XVIII wherein $R_{11}$ and $R_{16}$ are as defined above. By controlling the amount of polycarbonate employed so that the total number of carbonate units contained therein is less than the total number of available primary and secondary amines, the carbamates of formula XVIII will be formed. If excess polycarbonate is employed such that the total number of carbonate units is greater than the total number of available primary and secondary amines, carbamates of formula, XVI, which contain one or more carbonate units, are formed. These carbamates are useful dispersants and detergents and may be added to the lubricating oil or fuel as is. Alternatively, the carbamates of formula XVI may be treated with an excess of alcohol such as ethanol at elevated temperatures under transesterification conditions to remove the carbonate functions in formula XVI as shown in reaction (8) below:

$$R_{11}NH\overset{O}{\overset{\|}{C}}O(R_{16}O\overset{O}{\overset{\|}{C}}O)_pR_{15} + CH_3CH_2OH \longrightarrow \quad (8)$$

XVI $$R_{11}NH\overset{O}{\overset{\|}{C}}OR_{16}OH + CH_3CH_2O\overset{O}{\overset{\|}{C}}OCH_2CH_3 + R_{16}OH + R_{15}OH$$

XVIII

The carbamates of formula XVIII may be post-treated with a cyclic carbonate such as ethylene carbonate to form a hydroxy polyoxyalkylene derivative similar to that of formula X above.

Reaction (7) is conducted at a temperature sufficient to cause reaction of the polycarbonate, XIV, with the polyamino alkenyl or alkyl succinimide, IV. In particular, reaction temperatures of from about 0° C. to about 250° C. are preferred with temperatures of from about 100° C. to 200° C. being most preferred.

The reaction may be conducted neat—that is, both the polyamino alkenyl or alkyl succinimide and the polycarbonate are combined in the proper ratio, either alone or in the presence of a catalyst, such as an acidic, basic or Lewis acid catalyst, and then stirred at the reaction temperature. Examples of suitable catalysts include, for instance, phosphoric acid, boron trifluoride, alkyl or aryl sulfonic acid, alkali or alkaline carbonate.

Alternatively, the reaction may be conducted in a diluent. For example, the reactants may be combined in a solvent such as toluene, xylene, oil or the like, and then stirred at the reaction temperature. After reaction completion, volatile components may be stripped off. When a diluent is employed, it is preferably inert to the reactants and products formed and is generally used in an amount sufficient to insure efficient stirring.

Water, which can be present in the polyamino alkenyl or alkyl succinimide, may be removed from the reaction system either before or during the course of the reaction via azeotroping or distillation. After reaction completion, the system can be stripped at elevated temperatures (100° C. to 250° C.) and reduced pressures to remove any volatile components which may be present in the product.

Another embodiment of the above process is a continuous flow system in which the alkenyl or alkyl succinic anhydride and polyamine are added at the front end of the flow while the polycarbonate is added further downstream in the system.

Mole ratios of the individual carbonate units of polycarbonate to the basic amine nitrogen of the polyamino alkenyl or alkyl succinimide employed in the process of this invention are generally in the range of from about 0.1:1 to about 5:1 although preferably from about 0.5:1 to about 1:1.

The reaction is generally complete from within 0.5 to 10 hours.

Suitable polycarbonates may be prepared as described in U.S. Pat. No. 4,423,205. This patent is incorporated herein by reference for its teaching of the preparation of polycarbonates.

In preparing the polycarbonates of formula XIV, an excess of a suitable hydrocarbyl glycol, such as ethylene glycol, propylene glycol and the like, is added to a dihydrocarbyl carbonate, such as diethylcarbonate, under transesterification conditions to theoretically produce the polycarbonates of formula XIV(a) (i.e. m=0)

$$R_{15}(O\overset{O}{\overset{\|}{C}}OR_{16})_nO\overset{O}{\overset{\|}{C}}OR_{15} \quad \text{XIV(a)}$$

However, in practice, carbon dioxide is evolved during this reaction and the resulting polycarbonate contains some oxyhydrocarbyl content as shown below:

$$R_{15}[O\overset{O}{\overset{\|}{C}}OR_{16}(OR_{16})_m]_nO\overset{O}{\overset{\|}{C}}OR_{15}$$

wherein m is an integer generally from 0 to 10 or more and hydrocarbyl is derived the hydrocarbyl glycol employed. The amount of oxyhydrocarbyl content between the n carbonate units varies from carbonate unit to carbonate unit.

Preferred polycarbonates for use in this invention are those wherein $R_{15}$ is hydroxyalkylene and $R_{16}$ is alkylene wherein alkylene is from 2 to 10 carbon atoms; preferably 2 to 5 carbon atoms. Other preferred polycarbonates are those wherein $R_{15}$ is HO—Aryl—$R_{17}$—Aryl— and $R_{16}$ is —Aryl—$R_{17}$—Aryl— wherein $R_{17}$ is alkylene of from 2 to 5 carbon atoms and aryl is a $C_6$ to $C_{10}$ aryl. Suitable aryls include benzyl and naphthyl.

Chloroformates

Chloroformates and other haloformates react with a primary or secondary amine nitrogen of a polyamino alkenyl or alkyl succinimide to form carbamates. Suitable chloroformates include hydrocarbyl chloroformates of formula XIX below; hydroxy protected hydrocarbyl chloroformates of formula XX below and hydroxy protected poly(oxyalkylene) chloroformates of formula XXI:

$$R_{18}O\overset{O}{\overset{\|}{C}}Cl \qquad (R_{20}O)_w—R_{19}O\overset{O}{\overset{\|}{C}}Cl \qquad R_{20}O\text{-(alkylene-O)}_sC\overset{O}{\overset{\|}{C}}Cl$$

XIX XX XXI wherein w is an integer from 1 to 6; $R_{18}$ is hydrocarbyl of from 1 to 20 carbon atoms, $R_{19}$ is hydrocarbyl of 2 to 20 carbon atoms, $R_{20}$ is a hydroxy protecting group, alkylene is a $C_{2-C5}$ alkylene group and s is an integer from 2 to 30, preferably 2 to 20.

The chloroformates of formulas XIX, XX and XXI react with a primary or secondary amine to form a carbamate as shown in reaction (9) below:

$$R_{11}NH_2 + \text{XIX (or XX or XXI)} \longrightarrow R_{11}NH\overset{O}{\overset{\|}{C}}OR_{18} + HCl \quad (9)$$

IV XXII wherein $R_{11}$ and $R_{18}$ are as defined above.

Reaction (9) is conducted by contacting the chloroformate, XIX (or XX or XXI), with the polyamino alkenyl or alkyl succinimide, IV. The reaction may be conducted neat or in a suitable inert diluent. Suitable diluents include ethyl acetate, toluene, xylene, oil and the like. An organic base such as pyridine, triethylamine and the like may be added to the reaction to scavenge the acid generated. However, the generated acid is preferably removed by an alkaline water wash (pH of from 8–9) or an alkaline brine wash (pH 8–9) of the reaction solution after reaction completion without the need of added base. The reaction is generally conducted at from −78° C. to 50° C. with 0°–30° C. being preferred. However, when chloroformate XX or XXI is employed, and the protecting $R_{20}$ group is trichloroacetate, use of lower temperatures, i.e., −78° C. to 0° C. help prevent possible side products from forming and may be preferred for this purpose. The reaction is generally complete from within 0.5 to 24 hours. However, if the polyamino moiety of the alkenyl or alkyl succinimide contains hydroxyalkyl substitution, it is preferable to conduct reaction (9) at a sufficiently low temperature to prevent reaction of the chloroformate with the hydroxy group resulting in carbonate formation. Generally, temperatures of from −78° C. to 0° C. are sufficiently low to minimize this carbonate formation. In any event, any carbonate so formed from the hydroxyalkyl group during the chloroformate reaction may itself react with a primary or secondary amino nitrogen of the succinimide or may be readily removed by post-treating the product with an alkanol (e.g., ethanol) under transesterification conditions.

After the water washing, the product may be further isolated by conventional techniques such as chromatography, filtration and the like or used in reaction (10) without additional isolation.

The hydroxy protecting group, $R_{20}$, used in chloroformate, XX and XXI, is any acceptable hydroxy protecting groups which do not contain a functionality which is reactive with a chloroformate or an amine of the succinimide under the reaction conditions. Suitable protecting groups include benzyl, carbobenzoxy $(C_6H_5CH_2OC(=O)-)$, trichloroacetyl

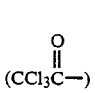

$(CCl_3C(=O)-)$ and the like. The identity of the particular protecting group is not critical provided it can be readily removed from the hydroxy group after reaction (9) is completed. For instance, trichloroacetyl may be removed by an alkaline brine wash (pH of from 8–9); by addition of a dialkylamine (e.g., dimethylamine into the reaction medium; or di-n-butylamine) or by an aqueous solution of tetrahydrofuran containing approximately 30% water at a pH 9–10, conducted at the completion of reaction (9) as shown in reaction (10) below:

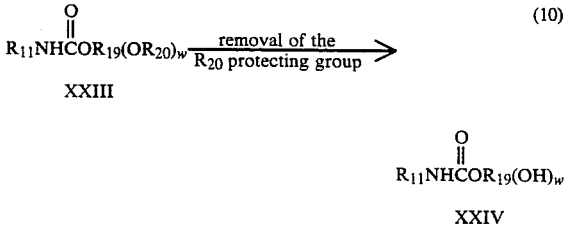

$$\underset{\text{XXIII}}{R_{11}NHC(=O)R_{19}(OR_{20})_w} \xrightarrow[R_{20}\text{ protecting group}]{\text{removal of the}} \underset{\text{XXIV}}{R_{11}NHC(=O)R_{19}(OH)_w} \quad (10)$$

More extreme reaction conditions (i.e. higher temperature or pH>9–10) may result in product decomposition. Removal of other $R_{20}$ protecting groups is well known in the art. For example, benzyl and carbobenzoxy protecting groups may be readily removed by hydrogenation using a suitable catalyst such as palladium on carbon. Similarly, carbobenzoxy protecting groups may also be removed by trifluoroacetic acid.

If additional chloroformate, XIX, XX, or XXI is added to the reaction it will react with any available primary or secondary amine of the polyamine alkenyl or alkyl succinimide and convert these to carbamates. Preferably, it is desirable to convert at least 20% of the primary and secondary amines to carbamates; more preferably at least 50% of the primary and secondary amines should be converted to carbamates; and most preferably all of the primary and secondary amines to carbamates.

In general, maximum carbamate formation in the polyamino alkenyl or alkyl succinimide can be obtained by employing a molar charge of chloroformate to the theoretical basic nitrogen of the alkenyl or alkyl succinimide of from 0.7:1 to about 1:1. In some cases, a slight excess of chloroformate may be employed to enhance reaction rate.

Suitable chloroformates of formula XIX include $C_1$ to $C_{20}$ alkyl chloroformates prepared from the corresponding alcohol by reaction with phosgene. The alcohols are either commercially available or may be readily prepared by reduction of the corresponding carboxylic acid by art recognized techniques.

Suitable chloroformates of formula XX wherein w=1 may be prepared as shown in reactions (11) and (12) below. In these reactions the protecting group $R_{20}$ is trichloroacetyl although it is understood that other suitable protecting groups may be similarly employed.

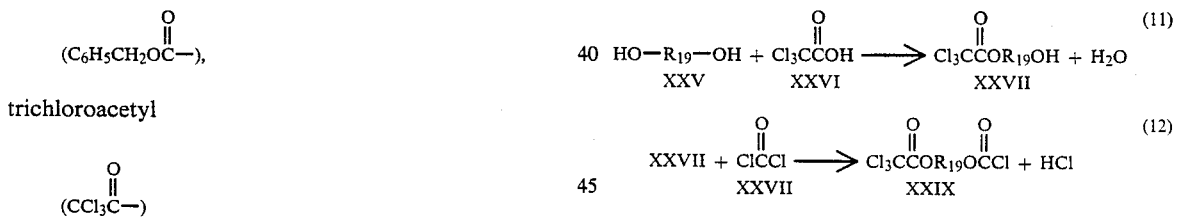

$$\underset{\text{XXV}}{HO-R_{19}-OH} + \underset{\text{XXVI}}{Cl_3CC(=O)OH} \longrightarrow \underset{\text{XXVII}}{Cl_3CC(=O)OR_{19}OH} + H_2O \quad (11)$$

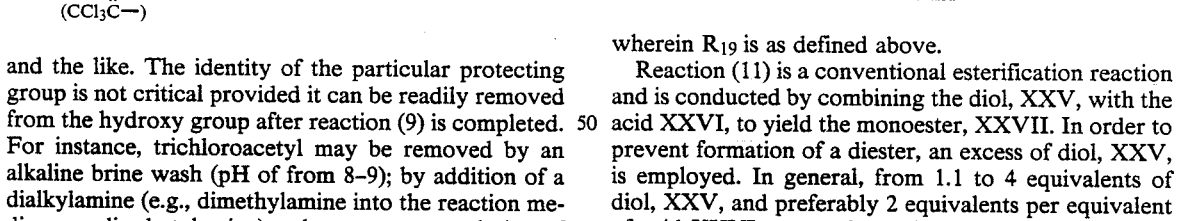

$$\underset{\text{XXVII}}{XXVII} + \underset{\text{XXVII}}{ClC(=O)Cl} \longrightarrow \underset{\text{XXIX}}{Cl_3CC(=O)OR_{19}OC(=O)Cl} + HCl \quad (12)$$

wherein $R_{19}$ is as defined above.

Reaction (11) is a conventional esterification reaction and is conducted by combining the diol, XXV, with the acid XXVI, to yield the monoester, XXVII. In order to prevent formation of a diester, an excess of diol, XXV, is employed. In general, from 1.1 to 4 equivalents of diol, XXV, and preferably 2 equivalents per equivalent of acid XXVI are employed in reaction (11) although larger excesses may be employed. The reaction may be conducted neat or in a suitable diluent such as toluene, benzene and the like. The water generated during the reaction may be readily removed via a Dean-Stark trap. The product ester, XXVII, may be isolated by conventional techniques such as chromatography, filtration and the like.

Alternatively, the monoester, XXVII, may be prepared by forming the diester of glycol XXV and then hydrolyzing one of the esters to the alcohol to form monoester XXVII.

Reaction (12) is conducted by adding the ester, XXVII, to a suitable inert diluent such as toluene, benzene and the like. Phosgene, XXVIII, is then added to the system over a period of time. Generally, an excess of phosgene is employed. In particular, from approximately 1.1–2.5 equivalents of phosgene is added per equivalent of ester, XXVII. The reaction is conducted at from −10° to 10° C. and is generally complete from within ½ to 12 hours. If it is necessary to prevent formation of side products, the ester, XVII, may be slowly added to an excess of phosgene XXVIII. The chloroformate, XXIX, may be isolated by conventional techniques such as distillation but preferably the system is stripped of a portion of the inert diluent which also removes the hydrochloride gas generated. The product XXIX, and the remaining diluent are then used as is in reaction (9) above.

The glycol, XXV, is either commercially available or may be readily prepared from art recognized techniques.

When w is 2 or more, the chloroformate, XX, is prepared similarly as to reactions (11) and (12) above. However, it is noted that excess polyol in these reactions is not necessary since all but one of the hydroxy groups of the polyol should be protected. Accordingly, if the polyol contains 4 hydroxy groups, three of these should be protected. This can be accomplished by using 3 equivalents of the protecting agent such as trichloroacetic acid. Alternatively, the triester may be prepared by first forming the tetraester and then hydrolyzing one of these esters to a hydroxy group to form the triester. In any case, a mixture is obtained from both procedures and the desired product being isolated by conventional techniques (i.e., chromatography).

Polyols are either commercially available (i.e. glycerol, pentaerythritol, etc.) or may be readily prepared by art recognized techniques.

Chloroformates of formula XXI are prepared similarly as those of formula XX by substituting a poly(oxyalkylene) glycol, XXX, in reactions (11) and (12) above.

$$HO(\text{alklyleneO})_sH$$

XXX wherein alkylene and s are as defined above.

The poly(oxyalkylene) glycol materials, XXX, are the addition polymers of lower aliphatic oxides such as ethylene oxide, propylene oxide, the butylene oxides and the pentylene oxides and are prepared by employing a glycol such as ethylene glycol, propylene glycol and the like under polymerization conditions. These materials are commercially available or may be readily prepared.

In the polymerization reaction, a single type of alkylene oxide may be employed, e.g., propylene oxide, in which case the product is a homopolymer, e.g., a poly(oxypropylene) propanol. However, copolymers are equally satisfactory and random copolymers are readily prepared by contacting the hydroxyl-containing compound with a mixture of alkylene oxides, such as a mixture of propylene and butylene oxides. Block copolymers of oxyalkylene units also provide satisfactory poly(oxyalkylene) polymers for the practice of the present invention.

In general, the poly(oxyalkylene) polymers are mixtures of compounds that differ in polymer chain length. However, their properties closely approximate those of the polymer represented by the average composition and molecular weight.

If the polyamino moiety of the alkenyl or alkyl succinimide does not contain hydroxy alkyl substitution, hydroxy alkyl groups may be introduced into the modified succinimides of this invention by addition of a chloroalkanol (e.g., chloroethanol) provided the succinimide retains some basic nitrogen. The chloroalkanol will react with basic nitrogen to yield the hydroxy alkyl group. This reaction may also produce some quaternized nitrogen products but this may be minimized by controlling the reaction conditions such as by limiting the amount of chloroalkanol added.

Alternatively, the hydroxy hydrocarbyl carbamates may be prepared by reacting the succinimide with an epoxide or hydrocarbyl hydroxy chloride in the presence of $CO_2$. Accordingly, by employing chloroformate, XIX, XX, or XXI, and a polyamino alkenyl or alkyl succinimide of formula II above in the above reactions, compounds of the following formula are produced.

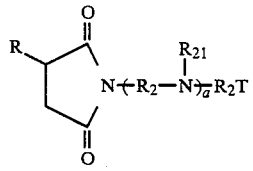

XXXI wherein R is alkenyl or alkyl of from 10 to 300 carbon atoms; $R_2$ is alkylene of from 2 to 10 carbon atoms; $R_{21}$ is hydrogen; lower alkyl of from 1 to 6 carbon atoms, lower hydroxy alkyl of from 1 to 6 carbon atoms, $$(HO)_t\text{hydrocarbyl-}\overset{O}{\overset{\|}{C}}O-$$

wherein t is an integer from 0 to 6, and hydrocarbyl is a hydrocarbyl group of from 2 to 20 carbon atoms; and $$HO(\text{alkylene-O})_s\overset{O}{\overset{\|}{C}}-$$

wherein alkylene-O is a $C_2$–$C_5$ oxyalkylene and s is an integer from 2 to 30; a is an integer of from 0 to 10; and T is $-NH_2$,

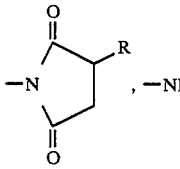

, $-NH\overset{O}{\overset{\|}{C}}O\text{-hydrocarbyl-(OH)}_t$ and $$-NH\overset{O}{\overset{\|}{C}}(O\ \text{alkylene})_sOH$$

wherein R, hydrocarbyl, alkylene, s and t are as defined above, with the proviso that if T is $-NH_2$or

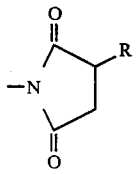

then a is not zero and at least one of $R_{21}$ is either $$(HO)_t\text{hydrocarbyl-}\overset{O}{\overset{\|}{C}}\text{, or HO}\leftarrow\text{alkylene-O}\rightarrow_s\overset{O}{\overset{\|}{C}}-.$$

Preferably R is alkenyl or alkyl of from about 12 to 100 carbon atoms; $R_2$ is alkylene of from 2 to 6 carbon atoms; a is an integer of from 1 to 6; $R_{21}$ is $$(HO)_t\text{hydrocarbyl-}\overset{O}{\overset{\|}{C}}-\text{, or HO}\leftarrow\text{alkylene-O}\rightarrow_s\overset{O}{\overset{\|}{C}}\text{;}$$

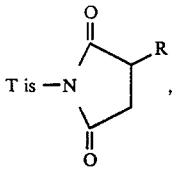

$$\text{T is} -N \quad \text{, (HO)}_t\text{hydrocarbyl-}\overset{O}{\overset{\|}{C}}-NH- \text{ or}$$

$$\text{HO}\leftarrow\text{alkylene-O}\rightarrow_s\overset{O}{\overset{\|}{C}}NH.$$

Preferably t is an integer of from 1 to 6, more preferably 1 to 3, most preferably 1. Carbon atoms having 2 hydroxy groups are hemiketals which readily lose water to form ketones (or aldehydes). For the purpose of this invention, if t is 2 or more then the hydroxy groups are not on the same carbon atom. Moreover, the carbon atom attached to the carbamate cannot be substituted with hydroxy since such hydroxy substitution would require that the starting alcohol XXV (or its equivalent if t is greater than 1) be a hemiketal which is not within the scope of this invention. Accordingly, when more than one hydroxy group is contained in the hydroxyhydrocarbyl group, no more than one hydroxy group is attached to the same carbon atom and the number of carbon atoms is minimally one greater than the number of hydroxy groups.

The modified polyamino alkenyl or alkyl succinimides described above are useful as detergent and dispersant additives when employed in lubricating oils. When employed in this manner, the modified polyamino alkenyl or alkyl succinimide additive is usually present in from 0.2 to 10 percent by weight to the total composition and preferably at about 0.5 to 5 percent by weight.

Group II Metal Overbased Sulfurized Alkylphenols

The Group II metal overbased sulfurized alkylphenols are well known commercially available lubricating oil additives. The preparation of these additives is described in U.S. Patent Nos. 3,178,368 and 3,367,867 which are incorporated herein in their entirety. In particular, strongly overbased additives can be prepared by (a) combining into an inert hydrocarbon diluent an alkylphenol wherein the alkyl group contains a sufficient number of carbon atoms to render oil-soluble the resulting Group II metal overbased sulfurized alkylphenol, an oilsoluble Group II metal overbased natural or synthetic hydrocarbyl sulfonate, and an alkanol of at least 8 carbon atoms; wherein the oil-soluble Group II metal overbased natural or synthetic hydrocarbyl sulfonate is employed at from about 1 to 20 weight percent to the alkylphenol, and the alkanol of at least 8 carbon atoms is employed at a molar ratio to the alkylphenol of from about 0.5 to about 5;

(b) heating the system to a temperature of from about 50° C. to about 155° C.;

(c) combining into the reaction system a Group II metal oxide, hydroxide or $C_1$–$C_6$ alkoxide and sulfur at a temperature sufficient to effect sulfurization of the alkylphenol followed by addition at from about 145° C. to about 165° C. of a $C_2$–$C_4$ alkylene glycol; wherein the Group II metal oxide, hydroxide or $C_1$–$C_6$ alkoxide is employed at a molar ratio to the alkylphenol of from about 1 to about 4,sulfur is employed at a molar ratio to the alkylphenol of from about 1.5 to about 4, the $C_2$–$C_4$ alkylene glycol is employed at a molar ratio to the alkylphenol of from about 1 to about 4;

(d) heating at a temperature sufficient to effect removal of a portion of the water in the system;

(e) heating the system to a temperature of from about 160° C. to about 190° C.;

(f) combining into the reaction system carbon dioxide wherein carbon dioxide is employed at a molar charge to the alkylphenol of from about 1 to 3; and (g) heating the system under reduced pressure at a temperature and pressure sufficient to remove a portion of the water, $C_2$–$C_4$ alkylene glycol and the alkanol of at least 8 carbon atoms.

The composition resulting from steps (a) through (g) is termed by the art as a Group II metal overbased sulfurized alkylphenol. Also included within the term "Group II metal overbased sulfurized alkylphenols" are the less highly overbased (i.e., less basic) Group II metal salts of sulfurized alkylphenols which possess a TBN greater than zero. Such salts are well known in the art and can be prepared by art recognized procedures such as combining the alkylphenol, sulfur and the Group II metal oxide, hydroxide or $C_1$–$C_6$ alkoxide under reactive conditions.

In step (c), after combination of the Group II metal oxide, hydroxide or $C_1$–$C_6$ alkoxide and sulfur, the temperature of the system is preferably raised, if necessary, from that of step (b) to about 150° C. to effect sulfurization of the alkylphenol. Also, in step (c), the $C_2$–$C_4$ alkylene glycol addition is preferably conducted at from about 150° C. to about 165° C. and even more preferably at from 150° C. to 160° C.

Step (d) is preferably conducted at a temperature sufficient to effect removal of a portion of the water in the reaction system without additionally removing significant amounts, i.e., greater than about 15%, of either the alkanol of at least 8 carbon atoms and the $C_2$–$C_4$ alkylene glycol. The water is generally removed from the system until approximately 50% of the water is removed and preferably 80% to 90% or more of the water is removed from the system. Step (d) is preferably conducted at from about 155° C. to about 165° C. and most preferably at about 160° C.

Step (e) is preferably conducted at from about 160° C. to about 180° C.

Step (g) involves heating the system under reduced pressures at a temperature and pressure sufficient to remove from the system a portion of the water, $C_2$–$C_4$ alkylene glycol and the alkanol of at least 8 carbon atoms. It is understood by those skilled in the art that the temperature required to remove a portion of the water, $C_2$–$C_4$ alkylene glycol and unreacted carbon dioxide is a function of pressure. That is lower temperatures require lower pressures to effect removal from the system of a portion of water, $C_2$–$C_4$ alkylene glycol and the alkanol of at least 8 carbon atoms. All that is required is a sufficiently high temperature and a sufficiently low pressure to effect removal. In general, temperatures of from greater than about 175° C. to about 200° C. and pressures from about 10 to about 50 mm of mercury or less have been found sufficient. Step (g) is generally continued until approximately all of the water, about 75% to about 90% of the $C_2$–$C_4$ alkylene glycol, and about 75% to about 90% of the alkanol of at least 8 carbon atoms are removed. Preferably, step (g) is continued until no additional $C_2$–$C_4$ alkylene glycol and/or alkanol of at least 8 carbon atoms is removed, i.e., distills in the overhead condensor.

The alkyl group of the alkylphenol employed in the method of the instant invention contains a sufficient number of carbon atoms to render the Group II metal overbased sulfurized alkylphenol oil-soluble. In general, alkyl groups of about 8 carbon atoms or more are sufficient to render the Group II metal overbased sulfurized alkylphenol oil-soluble.

In one preferred embodiment, the alkyl group of said alkylphenol contains from 25 to 100 mole percent predominantly straight-chain alkyl groups of from 15 to 35 carbon atoms and from 75 to 0 mole percent of the alkyl groups are polypropenyl of from 9 to 18 carbon atoms. More preferably, the alkyl group of said alkylphenol contains from 35 to 100 mole percent predominantly straight-chain alkyl groups of from 15 to 35 carbon atoms and from 65 to 0 mole percent of the alkyl groups are polypropenyl of from 9 to 18 carbon atoms. In yet another preferred embodiment, the alkyl group of said alkylphenol contains from 40 to 70 mole percent predominantly straight-chain alkyl groups of from 15 to 35 carbon atoms and from 60 to 30 mole percent of the alkyl groups are polypropenyl of from 9 to 18 carbon atoms. Most preferably, the alkyl group of said alkylphenol contains approximately 50 mole percent predominantly straight-chain alkyl groups of from 15 to 35 carbon atoms and approximately 50 mole percent of the alkyl groups are polypropenyl of from 9 to 18 carbon atoms.

As used herein, the term "Group II metal" means calcium, barium, magnesium, and strontium. Preferably, the Group II metal is selected from the group consisting of calcium, magnesium, barium, and mixtures thereof. Most preferably, the Group II metal is calcium.

As used herein, the term "Total Base Number" or "TBN" refers to the amount of base equivalent to milligrams of KOH in 1 gram of sample. Thus, higher TBN numbers reflect more alkaline products and therefore a greater alkalinity reserve.

Sulfur is generally employed at from about 1.5 to 4 moles per mole of the alkylphenol in the reaction system; preferably at from about 2 to 4 moles per mole of the alkylphenol and even more preferably at from about 2 to 3 moles per mole of alkylphenol. All allotropic forms of sulfur can be used. Alternatively, in place of sulfur, sulfur monochloride may be employed. For the purposes of this invention, sulfur monochloride is considered equivalent to sulfur. The sulfur may be employed either as molten sulfur or as a solid.

The Group II metal oxide, hydroxide or $C_1$–$C_6$ alkoxide used to prepare the Group II metal alkylphenol includes the oxides, hydroxides and alkoxides of calcium, strontium, barium or magnesium. However, calcium, barium and magnesium are preferred whereas calcium is most preferred. The Group II metal oxide, hydroxide, or $C_1$–$C_6$ alkoxide is employed at a molar charge to the alkylphenol of from about 1.5 to about 4; although preferably at from greater than 2 to 4; and even more preferably from greater than 2 to 3.

Carbon dioxide is added to the reaction system in conjunction with the Group II metal oxide, hydroxide or $C_1$–$C_6$ alkoxide to form overbased products and is generally employed from about 1 to 3 moles per mole of alkylphenol, although preferably from about 2 to 3 moles per mole of alkylphenol charged to the reaction system. Preferably, the amount of $CO_2$ incorporated into the Group II metal overbased sulfurized alkylphenol is less than about 9% by weight.

The alkylphenol employed in this invention is represented by the formula:

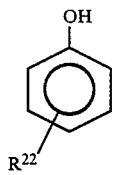

wherein $R_{22}$ is an alkyl group containing sufficient number of carbon atoms to render the resulting Group II metal overbased sulfurized alkylphenol oil-soluble.

Preferably, $R_{22}$ is alkyl wherein from about 25 to 100 mole percent of the alkyl group is predominantly straight-chain alkyl of from 15 to 35 carbon atoms and from about 75 to 0 mole percent of the alkyl group is polypropenyl of from 9 to 18 carbon atoms although more preferably $R_{22}$ is alkyl wherein from about 35 to 100 mole percent of the alkyl group is predominantly straight chain of from 15 to 35 carbon atoms and from about 65 to 0 mole percent of the alkyl group is polypropenyl of from 9 to 18 carbon atoms. Use of increasing amounts of predominantly straight chain alkyl results in high TBN products generally characterized by lower viscosities. On the other hand, while polypropenylphenols are generally more economical than predominantly straight chain alkylphenols, use of greater than 75 mole percent polypropenylphenol in the preparation of Group II metal overbased sulfurized alkylphenol generally results in products of unacceptably high viscosities. However, use of a mixture of from 75 mole percent or less of polypropenylphenol of from 9 to 18 carbon atoms and from 25 mole percent or more of predominantly straight chain alkylphenol of from 15 to 35 carbon atoms allows for more economical products of acceptable viscosities.

The alkylphenols of Formula I above are prepared by reacting the appropriate olefin or olefin mixture with phenol in the presence of an alkylating catalyst at a temperature of from about 60° C. to 200° C., and preferably 125° C. to 180° C. either neat or in an essentially inert solvent at atmospheric pressure. A preferred alkylating catalyst is a sulfonic acid catalyst such as Amberlyst 15 ® available from Rohm and Haas, Philadelphia, Pa. Molar ratio of reactants may be used. Alternatively, molar excess of phenol can be employed, i.e., 2–2.5 equivalents of phenol for each equivalent of olefin with unreacted phenol recycled. The latter process maximizes monoalkylphenol. Examples of inert solvents include benzene, toluene, chlorobenzene and 250 thinner which is a mixture of aromatics, paraffins and naphthenes.

The alkylphenols employed in this invention are either ortho alkylphenols of the formula:

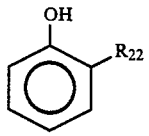

or para-alkylphenols of the formula:

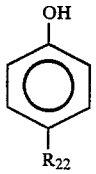

Preferably, $R_{22}$ is predominantly para with no more than about 50 mole percent of the $R_{22}$ alkyl group being in the ortho position; and more preferably no more than about 35 mole percent of the alkyl group being in the ortho position. It is believed that p-alkylphenols, III, facilitate the preparation of highly overbased Group II metal sulfurized alkylphenols. Accordingly, it is desirable to employ an olefin which results in maximum para alkylphenol content in the alkylphenol. In this regard, while polypropene generally adds in the para position, olefins containing no branching will add at both the ortho or para position. One method of enhancing the para content of the alkylphenol prepared from straight chain olefins is by use of a predominantly straight chain olefin fractions containing some branching in the molecular structure at the double bond such as structures IV and V

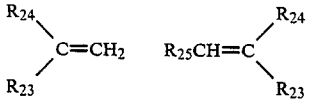

(vinylidine) (trisubstituted vinyl)

wherein $R_{23}$, $R_{24}$ and $R_{25}$ form the remainder of the olefin. While being predominantly straight chain, the branched portion of the molecular structure allows for formation of a tertiary carbonium ion during the alkylation process. Without being limited to any theory, it is believed that the stearic hindrance associated wit a tertiary carbonium ion inhibits ortho alkylation and thereby results in enhanced para substitution. Suitable predominantly straight chain olefins are those wherein about 75 to 100 number percent and preferably about 85 to 100 number percent of the individual carbon atoms of the olefin are either primary ($CH_3$—) or secondary (—$CH_2$—). Included in the terms primary or secondary are alpha olefins (—CH=$CH_2$) and internal olefins (—CH=CH—). In the converse, such predominantly straight chain olefins can contain from 0 to about 25 number percent although preferably from 0 to about 15 number percent of tertiary carbon atoms. Included within the term tertiary are trisubstituted vinyl groups ( C=CH—) and vinylidine C=$CH_2$)

Predominantly straight chain olefin fractions are commercially available products such as $C_{18}$–$C_{30}$ olefins, available from Ethyl Corporation, Baton Rouge, La. These olefins are predominantly straight chain in that from 80 to 100 number percent of the carbon atoms in the olefins are either primary or secondary. On the other hand, about 40 mole percent of the olefins contained in the olefin fraction are branched olefins. That is to say while being otherwise predominantly straight chain 40 mole percent of all of the olefins are branched in the form of trisubstituted vinyl or vinylidine structure. Likewise, $C_{24}$–$C_{28}$ olefin fractions, available from Chevron Chemical Corporation, San Francisco, Calif, are also predominantly straight-chain but contain about 40 mole percent or more branched olefin, containing predominantly vinylidine olefin. Straight chain olefins, containing less than about 5 mole percent branched olefins, are available from Shell Chemical Company, Houston, Tex.

This is the appropriate time to distinguish between "predominantly straight-chain olefins containing 80 to 100 number percent of either primary or secondary carbon atoms in the olefin" and a "predominantly straight-chain olefin fraction wherein about 40 mole percent of the olefins are branched". In the first case, the olefin is viewed on a molecular basis and requires that at least 80 number percent of the carbon atoms be primary or secondary. In this case, a branched olefin such as trisubstituted vinyl or vinylidine is nonetheless predominantly straight-chain if a sufficient number of the remaining carbon atoms are primary or secondary such that at least 80 number percent of the carbon atoms in this olefin are primary or secondary.

On the other hand, a predominantly straight-chain olefin fraction wherein about 40 mole percent of the olefins are branched as is viewed from a composition basis. That is the predominantly straight-chain olefin fraction can contain olefins such as alpha olefins, internal olefins, trisubstituted vinyl and vinylidine. When viewing the entire predominantly straight-chain olefin fraction, 40 mole percent of the olefins are branched, i.e., either trisubstituted vinyl or vinylidine, whereas the remainder are either alpha olefins or internal olefins.

The reaction to prepare the Group II metal overbased sulfurized alkylphenols of this invention also employs a $C_2$–$C_4$ alkylene glycol, preferably ethylene glycol, a high molecular weight alcohol (generally decyl alcohol) and a Group II metal overbased natural or synthetic hydrocarbyl sulfonate.

The $C_2$–$C_4$ alkylene glycol is generally employed at a molar charge to the alkylphenol of about 1 to 4, although preferably this molar charge is from about 2 to 3. Alternatively, 2-ethylhexanol may be employed in conjunction with $C_2$–$C_4$ alkylene glycol at weight ratios such as 80% by weight 2-ethylhexanol and 20% by weight ethylene glycol.

The high molecular weight alcohol, i.e., an alkanol of at least 8 carbon atoms, is employed at a molar charge to the alkylphenol from about 0.5 to 5, although preferably from about 0.5 to 4 and even more preferably from 1 to 2. Suitable alkanols of at least 8 carbon atoms include 1-octanol, 1-decanol, i.e., decyl alcohol, 2-ethylhexanol, etc.

The Group II metal overbased natural or synthetic hydrocarbyl sulfonates may be either petroleum sulfonate, synthetically alkylated aromatic sulfonates, or aliphatic sulfonates such as those derived from polyisobutylene. These sulfonates are well-known in the art. The hydrocarbyl group must have a sufficient number of carbon atoms to render the sulfonate molecule oil soluble. Preferably, the hydrocarbyl portion has at least 20 carbon atoms and may be aromatic or aliphatic, but is usually alkylaromatic. Most preferred for use are calcium, magnesium or barium sulfonates which are aromatic in character.

Certain sulfonates are typically prepared by sulfonating a petroleum fraction having aromatic groups, usually mono- or dialkylbenzene groups, and then forming the metal salt of the sulfonic acid material. Other feedstocks used for preparing these sulfonates include synthetically alkylated benzenes and aliphatic hydrocarbons prepared by polymerizing a mono- or diolefin, for example, a polyisobutenyl group prepared by polymerizing isobutene. The metallic salts are formed directly or by metathesis using well-known procedures.

The sulfonates are then overbased to yield products having Total Base Numbers up to about 400 or more by addition of carbon dioxide and a Group II metal hydroxide or oxide. Calcium hydroxide or oxide is the most commonly used material to produce the basic overbased sulfonates. Also included in the term "overbased" sulfonates are the basic natural or synthetic hydrocarbyl sulfonates prepared by utilizing an excess of Group II metal oxide or hydroxide over that which is necessary to form the neutral salts. All of these materials are well-known in the art.

The Group II metal overbased natural or synthetic hydrocarbyl sulfonate is employed at from about 1 to 20 weight percent to the alkylphenol, although preferably from about 1 to 10 weight percent. The Group II metal overbased natural or synthetic hydrocarbyl sulfonate described above are also employed in lubricating oil formulations in conjunction with the Group II metal overbased sulfurized alkylphenols; especially in marine crankcase formulations.

Alternatively, in lieu of a Group II metal overbased natural or synthetic hydrocarbyl sulfonate, a polyamino alkenyl or alkyl succinimide may be employed. When employed, the amount of alkenyl succinimide used is from about 1 to 20 weight percent to the alkylphenol, although preferably from about 1 to 10 weight percent.

Alternatively, in step (a), the inert hydrocarbon diluent can be omitted, and if this is done, the inert diluent is generally added after step (f).

In step (a), it may be desirable to employ a sulfurization catalyst. The sulfurization catalyst facilitates the addition of the sulfur onto the alkylphenol. When employed, the sulfurization catalyst is added together with the alkylphenol, the oil-soluble Group II metal overbased natural or synthetic hydrocarbyl sulfonate, and the alkanol of at least 8 carbon atoms.

Particularly preferred sulfurization catalysts include 2-mercaptobenzothiazole and calcium polysulfide. The sulfurization catalyst is generally employed at from about 0.5 to 10 weight percent to the alkylphenol in the reaction system and preferably at from about 1 to 2 weight percent. In a preferred embodiment, the sulfurization catalyst is added to the reaction mixture as a liquid. This can be accomplished by dissolving the sulfurization catalyst in molten sulfur or in the alkylphenol as a premix to the reaction. The Group II metal overbased sulfurized alkylphenols employed in this invention have a Total Base Number ranging from greater than zero for the Group II metal salts of sulfurized alkylphenols up to about 400 for the Group II metal highly overbased sulfurized alkylphenols.

These Group II metal overbased sulfurized alkylphenols provide dispersancy/detergency, alkalinity reserve and antioxidancy when employed at from about 0.5 to 40 weight percent in lubricating oil although, preferably, these additives are used at from about 1 to 25 weight percent in the lubricating oil.

The lubricating oil compositions employ a finished lubricating oil which may be single or multigrade. Multigrade lubricating oils are prepared by adding viscosity index (VI) improvers. Typical viscosity index improvers are polyalkyl methacrylates, ethylene, propylene copolymers, styrene-diene copolymers, and the like. So-called decorated VI improvers having both viscosity index and dispersant properties are also suitable for use in the formulations of this invention.

The lubricating oil used in such compositions may be mineral oil or synthetic oils of viscosity suitable for use in the crankcase of an internal combustion engine such as gasoline engines and diesel engines which include marine engines. Crankcase lubricating oils ordinarily have a viscosity of about 1300 cSt 0° F. to 24 cSt at 210° F. (99° C.). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha-olefins having the proper viscosity. Especially useful are the hydrogenated liquid oligomers of $C_6$ to $C_{12}$ alpha-olefins such as 1-decene trimer. Likewise, alkyl benzenes of proper viscosity such as didodecyl benzene, can be used. Useful synthetic esters include the esters of both mono-carboxylic acid and polycarboxylic acids as well as mono-hydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 weight percent hydrogenated 1-decane trimer with 75 to 90 weight percent 150 SUS (100° F.) mineral oil gives an excellent lubricating oil base.

The following examples are offered to specifically illustrate this invention. These examples and illustrations are not to be construed in any way as limiting the scope of this invention.

EXAMPLES

EXAMPLE 1

To a 5-liter reaction flask fitted with a stirrer, Dean-Stark trap, condensor and nitrogen inlet, was charged 2000 g of a succinimide dispersant composition [prepared by reacting 1 mole of polyisobutenyl succinic anhydride, where the polyisobutenyl group has a number average molecular weight of about 950, with 0.9 mole of triethylenetetramine then diluting to about 50% actives with diluent oil to give a material with an AV=40.9 mg KOH/g]. To this mixture was added 352 g ethylene carbonate. The reaction mixture was stirred and heated at 150° C. under N2 for 4 hours, then stripped for 30 minutes at 175°-180° C. and 2 mm Hg. Recovered 2020 g of product with AV=25.5.

EXAMPLE 2

To a 5-liter reaction flask was added 2000 g of a succinimide dispersant composition as described in Example 1 and 352 g ethylene carbonate. The mixture was stirred and heated at 150° C. under $N_2$ for 4 hours. The product was then cooled, diluted with 400 g diluent, and stripped to 200° C. and 10 mm Hg. Recovered 2048 g of product with AV=25.4 and containing 2.13% N.

EXAMPLE 3

To a 500-ml reaction flask was charged 100 g of a succinimide dispersant composition [prepared by reacting 1 mole of polyisobutenyl succinic anhydride, where the polyisobutenyl group has a number average molecular weight of about 950, with 0.87 mole of tetraethylenepentamine; then diluting to about 50% actives with diluent oil to give a material with an AV=46.3 mg KOH/g]. The succinimide was warmed to 150° C., 29.9 g ethylene carbonate was added, and the mixture stirred and heated at 150° C. under $N_2$ for 4 hours. The product was then cooled, diluted with 250 hydrocarbon thinner which is a mixture of aromatics, paraffins and naphthenes, and stripped to 175° C. and 13 mm Hg. Recovered 117.5 g of product having an AV=24.3 and containing 1.74% N.

EXAMPLE 4

To a 3-liter reaction flask was charged 1500 g of a succinimide dispersant composition [prepared by reacting 1 mole of polyisobutenyl succinic anhydride, where the polyisobutenyl group has a number average MW of about 950, with 0.5 mole of tetraethylenepentamine then diluting to about 50% actives with diluent oil and to give a material with an AV=27.5]. The succinimide was warmed to 170° C. and 171 g ethylene carbonate added over a period of about 5 minutes. The reaction mixture was stirred at 170° C. under $N_2$ for 4 hours to yield 1605 g of product with AV=15.5 and containing 1.40% N.

EXAMPLE 5

To a 3-liter reaction flask was charged 1700 g of the succinimide dispersant composition of Example 4. The succinimide was warmed to 170° C. under $N_2$ and 88.5 g ethylene carbonate was added. The reaction mixture was stirred and i0 heated at 170° C. for 4 hours. Recovered 1702 g product having an AV=16.0 and containing 1.32% N.

EXAMPLE 6

To a 500-ml reaction flask was charged 100 g of succinimide dispersant composition of Example 4 and 5.91 g propylene carbonate. The reaction mixture was stirred and heated under nitrogen at 150° for 4 hours. The product was then cooled, diluted with 350 thinner, and stripped to 175° C. and 10 mm Hg. Recovered 102.6 g of product with an AV=21.9 and containing 1.31% N.

EXAMPLE 7

To a 500-ml flask was charged 150 g succinimide dispersant composition of Example 4 and 150 ml xylenes. The reaction mixture was brought to reflux and 17.1 g ethylene carbonate, mixed with 20 ml xylenes at 64° C., was added. The mixture was refluxed under $N_2$ for 4 hours, then stripped to 170° C. and 50 mm Hg. Recovered 157.8 g product having an AV=23.5 and containing 1.46% N.

EXAMPLE

To a 500-ml reaction flask was charged 150 g succinimide dispersant composition of Example 4. The succinimide was warmed to 170° C. and 17.1 g ethylene carbonate was then added over a period of 65 minutes. The reaction mixture was stirred and heated at 170° C. under $N_2$ for another 3 hours. Recovered 161.6 g product having an AV=15.9 and containing 1.40% N.

EXAMPLE 9

To a 1-liter reaction flask was charged 500 g succinimide dispersant composition of Example 4. This material was then stripped to 170° C. and 5 mm Hg to remove 1.5 g entrained water. 56.8 g Ethylene carbonate was then added over a 2-minute period and the reaction mixture stirred and heated at 170° C. under $N_2$ for 4 hours. Recovered 535.7 g product having AV=14.2 and containing 1.36% N.

EXAMPLE 10

To a 5-liter reaction flask was charged 2800 g succinimide dispersant composition of Example 4 and 493 g ethylene carbonate. The reaction mixture was then stirred and heated at 150° C. under $N_2$ for 4 hours. The product was cooled, diluted with 600 ml 450 thinner and stripped to 210° C. and 10 mm Hg. Recovered 2952 g product having an AV=12.3 and containing 1.25% N.

EXAMPLE 11

To a 500 ml 3 neck flask fitted with a stirrer, Dean-Stark trap, condensor and nitrogen inlet was charged 250 g of a 50% oil solution of a polybutenyl succinic anhydride (average mw=1050). 17.9 g of Dow E-100® heavy polyamine (average mw=303 available from Dow Chemical Company, Midland, Mich.) was added over 30 minutes. The mixture was heated and stirred at 170° C. for 3 hrs. To this mixture was added 52 g ethylene carbonate. This system was stirred at 160° C. for 4 hrs. Recovered 296.5 g of product with AV=27.1 and N=1.9%.

EXAMPLE 12

To a 250 ml 3 neck flask fitted with a stirrer, Dean-Stark trap, condensor and nitrogen inlet was charged 140 g of a 50% oil solution of a polybutenyl succinic anhydride (average mw=1400). 4.75 g of tetraethylene pentaamine (mw=189) was added over 30 minutes. The mixture was heated and stirred at 170° C. for 3 hrs. To this mixture was added 13.2 g of ethylene carbonate (mw=88). This system was stirred at 170° C. for 3 hrs. Recovered 143.6 g of product with AV=13.3 and N=1.2%.

EXAMPLE 13

To a 250 ml 3 neck flask fitted with a stirrer, Dean-Stark trap, condensor and nitrogen inlet was charged 100 g of the succinimide dispersant composition of Example 4 and 13.2 g of 1,3-dioxan-2-one. The mixture was heated at 165° C. for 3 hrs. under nitrogen. After cooling the recovered product had an AV=18.1.

Similarly, other polyamino alkenyl or alkyl succinimides may be employed in place of the succinimides used in Examples 1–13 to produce modified succinimides useful in this invention. Examples of suitable succinimides include the reaction product of either polyisopropenyl succinic anhydride or polyisobutenyl succinic anhydride with bisaminopropylethylene diamine and the reaction product of a hydrogenated polyisobutenyl succinic anhydride with tetraethylene pentamine.

EXAMPLE 14

A 500 ml, 3-necked flask was charged with 123.3 g succinimide dispersant composition of Example 4 and 46 g pentaerythritol carbonate (spiro[1,3-oxa-2-cyclohexanone-5,5'-1',3'-oxa-2'-cyclohexanone]) which was prepared by reacting pentaerythritol with an excess of diethylcarbonate in the presence of catalytic amounts of potassium carbonate. The system was stirred and heated under nitrogen to 175° C. for 6½ hours to yield 138 g of a product having an AV=12.6.

EXAMPLE 15

A 500 ml, 3-necked flask was charged with 100 g succinimide dispersant composition of Example 4. The system is heated to 100° C. and 7.64 g of a mixture of 4-hydroxy- methyl-1,3-dioxolan-2-one and 5-hydroxy-1,3-dioxan-2-one (which was prepared by reacting glycerol with an equivalent of diethylcarbonate in the presence of catalytic amounts of potassium carbonate without purifying the resulting product) was then added. The system was stirred and heated under nitrogen to 165° C. for 3 hours to yield 104.7 g of a product having % N=1.48.

Likewise, by following the procedures in the above examples, the following cyclic carbonates may be substituted for ethylene carbonate (1,3-dioxolan-2-one) to yield modified succinimides useful in this invention:

4-methyl-1,3-dioxolan-2-one; 4-hydroxymethyl-1,3-dioxolan-2-one; dioxolan-2-one; 4,5-dimetyl-1,3-dioxolan-2-one; 4-ethyl-1,3-dioxolan-2-one; 4-methyl,5-ethyl-1,3-dioxolan-2-one; 4,4-dimethyl-1,3-dioxolan-2-one; 4-n-propyl-1,3-dioxolan-2-one; 4,4-diethyl-1,3-dioxolan-2-one; 1,3-dioxan-2-one; 4,4-di- methyl-1,3-dioxan-2-one; 5,5-dimethyl-1,3-dioxan-2-one; 5-methyl-1,3-dioxan-2-one; 4-methyl-1,3-dioxan-2-one; 5-hydroxymethyl-1,3-dioxan-2-one; 5,5-diethyl-1,3-dioxan-2one; 5-methyl-5-npropyl-1,3-dioxan-2-one; 4,6-dimethyl-1,3-dioxan-2-one; 4,4,6-trimethyl-1,3-dioxan-2-one and spiro[1,3-oxa-2-cyclohexanon-5,5'-1',3'-oxa-2'-cyclohexanone].

EXAMPLE 16

A linear polyethylene carbonate was prepared according to U.S. Pat. No. 3,248,414. A stirred steel autoclave was charged with 12.4 g ethylene glycol, 274 g ethylene carbonate, and 0.4 g potassium carbonate. The temperature was raised to 200° C. and held there for 24 hours. The pressure in the vessel rose from 155 psi to 1300 psi and was constant at 1300 psi for at least the last 5 hours of the reaction. The reactor temperature was lowered to 115°-120° C. and the reaction gases were vented. The product was then stripped under vacuum to 165°-170° C. to remove excess ethylene carbonate. Recovered 158.9 g product having an hydroxyl number of 157 and containing 14.9 weight percent $CO_2$.

EXAMPLE 17

A 500 ml, 3-necked flask was charged with 80 g monosuccinimide dispersant composition of Example 3 and 20.8 g polycarbonate of Example 21. The mixture was stirred and heated under nitrogen for 4 hours at 160° C., whereupon the AV of the mixture dropped from 39.8 to 33.8 mg KOH/g. The mixture was then heated at 180° C. for another 5 hours, whereupon the AV dropped to 28.7 mg KOH/g. The mixture was finally heated at 200° C. for 2½ hours to give a product having an AV=28.4 mg KOH/g and showing no unreacted carbonate by infrared spectroscopy.

EXAMPLE 18

A 500 ml, 3-necked flask was charged with 100 g bissuccinimide dispersant composition of Example 4, 11.8 g polycarbonate of Example 21, and 180 ml p-dioxane. The mixture was refluxed for 1 hour, then the p-dioxane was removed by distillation. The remaining reaction mixture was warmed to 180° C. under nitrogen for 5 hours, then at 220° C. for 5½ hours. Recovered a product having an AV=17.6 mg KOH/g.

EXAMPLE 19

To a 250 ml, 3-necked flask was charged 46.4 g of a bissuccinimide dispersant composition of Example 4 and 1.3 g of a polycarbonate resin having the generic formula $—C_6H4-C(CH_3)2-C_6H_{45}OCO_2n$ and an MW=20,000-25,000 (available from Aldrich Chemical Co., Milwaukee, Wis., as Aldrich No. 78,162-5). The mixture was heated under nitrogen to 150° C. for 5 hours. Recovered 0.7 g unreacted polycarbonate resin. The recovered product had an AV=25.3 mg KOH/g.

EXAMPLE 20

To a 250 ml, 3-necked flask was charged 46.4 g of the bissuccinimide dispersant composition of Example 4 and 5.1 g polycarbonate resin as described in Example 24. The mixture was heated under nitrogen to 150°-160° C. for 3½ hours, then to 180°-190° C. for another 1½ hours. Recovered 3.15 g unreacted polycarbonate resin. The product contained 1.42% N and had an AV=16.4 mg KOH/g.

EXAMPLE 21

To a 500 ml, 3-necked flask was added 5.1 g of the polycarbonate resin described in Example 19 and 100 g p-dioxane. The solvent was refluxed until all the resin had dissolved. 46.4 g of the bissuccinimide dispersant composition of Example 4 was then added and refluxing continued for another 21 hours. The reaction mixtures was then stripped to remove dioxane and heated to 180°-190° C. under $N_2$ for 3 hours. The product contained 1.32% N and had an AV=10.0 mg KOH/g.

EXAMPLE 22

To a 3-liter, 3-necked flask was charged 1700 g of a bissuccinimide (prepared by reacting 2 moles of polyisobutenyl succinic anhydride where the polyisobutenyl group has a number average MW=950, with 1 mole of tetraethylene pentamine then diluting to about 50% actives with diluent oil to give a material with an AV=27.5). The bissuccinimide was brought to 170° C. under a nitrogen atmosphere and 88.5 g ethylene carbonate was added over a period of about three minutes. The mixture was stirred at 170° C. for 4 hours. Recovered 1762 g product containing 1.32% nitrogen and having an AV=15.7 mg KOH/g.

EXAMPLE 23

To a 500 ml, 3-necked flask was charged 132.6 g of the product of Example 22 and 76.5 g of an approximately 50% oil solution of polyisobutenyl succinic anhydride (MW=1050). The mixture was stirred and heated under nitrogen at 160° C. for 2 hours. Recovered 209.2 g product containing 0.85% N and having an AV=8.4 mg KOH/g.

EXAMPLE 24

To a 3-liter, 3-necked flask was charged 1500 g of a bissuccinimide dispersant composition of Example 22. The succinimide was warmed to 170° C. under a nitrogen atmosphere and 171 g ethylene carbonate was added over a period of 8 minutes. The mixture was stirred at 170° C. for 4 hours. Recovered 1605 g product containing 1.41% N and having an AV=15.5 mg KOH/g.

EXAMPLE 25

To a 500 ml, 3-necked flask equipped with a nitrogen inlet, mechanical stirrer and addition funnel was charged 150 g of the monosuccinimide dispersant composition of Example 3 and 20.9 g of diethylcarbonate. The reaction system was heated to 160° C. for 6 hours. The temperature was raised to 175° C. and then the reaction system was stripped under vacuum to remove volatiles and some diluent oil. 150.5 g of the product was recovered having an AV=42.2. Infrared shows carbamate and succinimide bands at from 1710 $cm^{-1}$ to 1690 $cm^{-1}$.

EXAMPLE 26

To a 100 ml flask under nitrogen equipped with a stirrer and an addition funnel was charged 5 g of the bissuccinimide dispersant composition of Example 22. Afterward approximately 1.5 g of methyl chloroformate was slowly added dropwise over 1 hour to the reaction system at a temperature of from 25° C. to 30° C. at this time, infrared analysis shows the presence of unreacted chloroformate. The reaction was exothermic and the system was heated from 45° to 75° C. over 1 hour and then allowed to cool and 250 hydrocarbon thinner, which is a mixture of aromatics, paraffins and naphthenes, was added. The organic solution was washed with brine to remove hydrogen chloride and unreacted chloroformate and then stripped to yield methyl carbamate derivatives of the bissuccinimide having an AV=5.42.

EXAMPLE 27

To a 3-liter, 3-necked flask is charged 1,250 g of the monosuccinimide dispersant composition of Example 3. Afterwards, 276 g of tetradecyl chloroformate (prepared by reacting 1-tetradecanol with phosgene) is slowly added to the reaction system at a temperature from 20°-25° C. The reaction system is stirred at this temperature for 2 hours at which time the reaction solution is added to 250 hydrocarbon thinner which is a mixture of aromatics, paraffins, and naphthenes. The organic solution is washed with brine and then stripped to remove volatiles to yield a dispersant product containing tetradecyl carbamate functionalities.

EXAMPLE 28

To a 5-liter, 3-necked flask is charged 1,250 g of the monosuccinimide dispersant composition of Example 3. Afterwards, 1,440 g of eicosyl chloroformate (prepared by reacting 1-eicosanol with phosgene) is slowly added to the reaction system at a temperature from 20°-25° C. The reaction system is stirred at this temperature for 3 hours at which time the reaction solution is added to 250 hydrocarbon thinner which is a mixture of aromatics, paraffins and naphthenes. The organic solution is washed with brine and then stripped to remove volatiles to yield a dispersant product containing eicosyl carbamate functionalities.

EXAMPLE 29

Preparation of Ethylene Glycol Mono-Trichloroacetate

To a 3-neck flask equipped with a nitrogen inlet tube, a mechanical stirrer and a dean stark trap was added 37.2 g of ethylene glycol (0.6 moles) and 49.0 g of trichloroacetic acid (0.3 moles). The mixture was heated at 150° C. for 3.5 hours. Water distills out of the reaction mixture and is collected in the Dean-Stark trap. After cooling, the crude mixture was dissolved in 150 ml of methylene chloride and was washed three times with 150 ml of ice water. The organic phase was dried over anhydrous sodium sulfate, filtered and the solvent was removed under vacuum to give the mono-trichloroacetate as the major product.

A sample of ethylene glycol mono-trichloroacetate, prepared similarly to the procedure outlined above, was placed on TLC (thin layer chromatography). TLC shows the mono-trichloroacetate having a Rf=0.33 and the trichloroacetate having a $R_f$=0.67 using 1/5 ethyl acetate/petroleum ether as development solvent and a dichromate stain for visualization.

A sample of mono-trichloroacetate was purified by silica gel chromatography The crude material (90.8 g) was placed on a column packed with 484 g of silica gel and eluted with 5% ethyl acetate/hexane. The mono-trichloroacetate has an $R_f$=0.25 in this solvent system and 58.2 g was obtained as single spot material. IR shows hydroxy at 3400 $cm^{-1}$ and carbonyl at 1765 $cm^{-1}$ NMR (CDC13) shows 1H(—OH) at delta 3.35, 2H(—$CH_2$—O) at delta 4.0 and 2H(C—O—$CH_2$—C) at delta 4.55. The bis-trichloroacetate was also obtained pure by silica gel chromatography. IR shows carbonyl at 1770 $cm^{-1}$ and no hydroxy. NMR ($CDCl_3$) shows only 4H(—$CH_2$—O) at delta 4.75.

EXAMPLE 30

Preparation of Chloroformate of Ethylene Glycol Mono-Trichloroacetate

Ethylene glycol mono-trichloroacetate, 14.5 g, 0.07 moles, was dissolved in 100 ml of toluene and excess phosgene was carefully passed through the solution for several hours. (The reaction was performed in a well ventilated hood and a KOH scrubber was used to destroy unreacted phosgene and HCl gas). The reaction was monitored by TLC until all of the starting material was gone. After the reaction was completed, nitrogen was bubbled through the solution to remove any unreacted phosgene. The toluene solution containing the chloroformate can be used in subsequent reactions.

A sample of the chloroformate of ethylene glycol mono-trichloroacetate was prepared similarly to the procedure outlined above and placed on a TLC. The chloroformate appears as a new single spot on TLC at $R_f$=0.6 using ⅓ ethyl acetate/hexane as solvent (dichromate visualization). A portion of a chloroformate/toluene solution was stripped and IR shows carbonyl (trichloroacetate and chloroformate) at 1770 $cm^{-1}$ and no hydroxyl group. NMR shows a broad 4H singlet at delta 4.7.

EXAMPLE 31

Preparation of a Hydroxy Ethyl Carbamate Modified Succinimide. Reaction of Protected Chloroformate with Bissuccinimide (a) The chloroformate of ethylene glycol monotrichloroacetate, 3.9 g (0.0144 moles) was dissolved in 20 ml toluene. 20.3 g of a bissuccinimide dispersant composition (prepared by reacting 1 mole of polyisobutenyl succinic anhydride, where the polyisobutenyl group has a number average MW of about 950, with 0.5 mole of tetraethylene pentaamine then diluting to about 50% actives in diluent oil to give a material with an AV=29.7 and a nitrogen content of 1.51%) was dissolved in 25 ml of toluene. Both solutions were cooled to below 0° C. (approximately −2° C.) using a salt ice-water bath. The solutions were poured together into a 500 ml flask equipped with a mechanical stirrer and drying tube attached. The reaction solution was mixed with strong stirring and kept below 0° C. for 40 minutes and then allowed to warm to room temperature.

(b) After stirring at room temperature for several hours, about 65 mls of the reaction solution was added to 130 mls hexane and 65 mls 1N NaOH in a separatory funnel in order to remove the trichloroacetate group. The mixture was intermittently shaken for 30 minutes. After phase separation, the organic layer was washed several times with brine, dried over anhydrous magnesium sulfate, filtered and stripped to yield the title product having an AV=18.4. The infrared spectrum of this product contains a hydroxy band at 400 $cm^{-1}$ and succinimide and carbamate bands at 1710 $cm^{-1}$ to 1690 $cm^{-1}$.

(c) Alternatively, the trichloroacetyl group may be removed as follows:

A 5-ml sample from (a) above was added to 10 ml of hexane and about 0.25 ml of di-n-butyl amine. Afterwards, the solution was stirred in a 50 ml flask at room temperature overnight and then heated to 40° C. for 40 minutes, followed by 2 additional hours at room temperature. An aliquot was then removed and stripped. Infrared analysis of this sample indicated that the trichloroacetyl group had been removed. The reaction mixture was then washed several times with brine and then stripped under vacuum to yield a product identical to that produced in (b) above.

EXAMPLE 32

(a) The chloroformate of ethylene glycol monotrichloroacetate, 1.7 g, was dissolved in 25 ml toluene. 3.8 g of a bissuccinimide (prepared by reacting 1 mole of dodecenyl succinic anhydride with 0.5 mole of diethylene triamine to yield the bissuccinimide) was dissolved in 35 ml of toluene. Both solutions were cooled to below 0° C. (approximately −2° C.) using a salt ice-water bath. The solutions were poured together into a flask equipped with a mechanical stirrer and drying tube. The reaction solution was mixed with strong stirring and kept below 0° C. for 40 minutes and then allowed to warm to room temperature. After reaction completion, the reaction solution was stripped under vacuum to yield a crude product. This product was purified by column chromatography using 80 g silica gel and 1:1 ethyl acetate/hexane as the eluting solvent to recover 3.7 g of the trichloroacetyl ethyl carbamate of the bissuccinimide. Infrared analysis shows a trichloroacetyl band at 1770 $cm^{-1}$ and succinimide and carbamate bands at 1710–1690 $cm^{-1}$.

(b) 1 Gram of the product of (a) above was added to 20 ml hexane and 10 ml 1N NaOH in order to remove the trichloroacetate group, the mixture was intermittently mixed. After phase separation, the organic layer was washed several times with brine, dried over anhydrous magnesium sulfate, filtered and stripped to yield the title compound.

EXAMPLE 33

Preparation of Glycerol Di-(trichloroacetate)

To a 3-neck flask equipped with a nitrogen inlet tube, a mechanical stirrer and a Dean-Stark trap is added 92 g of glycerol and 326.8 g of trichloroacetic acid. The mixture is heated at 150° C. for 3.5 hours. Water distills out of the reaction mixture and is collected in the Dean-Stark trap. After cooling, the crude mixture is dissolved in 150 ml of methylene chloride and is washed three times with 150 ml of ice water. The organic phase is dried over anhydrous sodium sulfate, filtered and the solvent is removed under vacuum to give the di(trichloroacetate) of glycerol which is purified by column chromatography using silica gel.

EXAMPLE 34

Preparation of Chloroformate of Glycerol Di-(trichloroacetate)

Glycerol di-(trichloroacetate) 36.1 g, is dissolved in 200 ml of toluene and excess phosgene is carefully passed through the solution for several hours. (The reaction is preformed in a well ventilated hood and a KOH scrubber is used to destroy unreacted phosgene and HCl gas.) The reaction is monitored by TLC until all of the starting material is gone. After reaction completion, nitrogen is bubbled through the solution to remove any unreacted phosgene to yield a toluene solution containing the title product.

EXAMPLE 35

The chloroformate of glycerol di(trichloroacetate), 42.3 g, is dissolved in 200 ml toluene. 300 Grams of a monosuccinimide dispersant composition (prepared by reacting 1 mole of polyisobutenyl succinic anhydride, where the polyisobutenyl group has a number average molecular weight of about 950, with 0.87 mole of tetraethylene pentaamine then diluting to about 50% actives in diluent oil) is dissolved in 200 ml toluene. Both solutions are cooled to below 0° C. (approximately −2° C.) using a salt ice-water bath. The solutions are poured together into a 2-liter flask equipped with a mechanical stirrer and a drying tube. The reaction solution is mixed with strong stirring and kept below 0° C. for 40 minutes and then is allowed to warm to room temperature. After stirring at room temperature for several hours, about 65 mls of the reaction mixture is added to 130 mls hexane and 65 mls 1N NaOH in a separatory funnel in order to remove the trichloroacetate group. The mixture is intermittently shaked for 30 minutes. After phase separation, the organic layer is washed several times with brine, is dried over anhydrous magnesium sulfate, is filtered and stripped to yield dihydroxypropyl carbamate derivatives of the monosuccinimide.

EXAMPLE 36

To a 3-neck flask equipped with a nitrogen inlet tube, a mechanical stirrer and a Dean-Stark trap is added 36 g of polyethylene glycol (average MW=600 - available from Aldrich Chemical Co., Milwaukee, Wis. as Aldrich 20,240-1) and 4.9 g of trichloroacetic acid. The mixture is heated at 150° C. for 3.5 hours. Water distills out of the reaction mixture and is collected in the Dean-Stark trap. After cooling, the crude mixture is dissolved in 150 ml of methylene chloride and is washed three times with 150 ml of ice-water. The organic phase is dried over anhydrous sodium sulfate, filtered and the solvent is removed to give polyethylene glycol monotrichloroacetate which is purified by column chromatography using silica gel.

By following the procedures outlined in Examples 30, 31, 32, 34 and 35, the chloroformate of the polyethylene glycol monotrichloroacetate is prepared which then is reacted with a succinimide of this invention and then is then deprotected to yield a succinimide wherein one or more of the basic nitrogens has been converted to a hydroxy polyoxyethylene carbamate.

By following the procedures of Examples 20-36, the following alkylene glycols may be substituted for ethylene glycol:

1,3-propylene glycol; 1,3-butanediol; 1,4-butanediol; 1,4-pentanediol; 1,5-pentanediol; 1,6-hexanediol; 1,9-nonanediol; 1,10-decanediol; 1,2-octadecanediol; 1,2-hexadecanediol; pentaerythritol and glucose.

EXAMPLE 37

To a 500-ml 3-neck flask equipped with a stirrer, Dean-Stark trap, condensor and nitrogen inlet is charged 106 grams (1 equivalent) of a multiply adducted alkenyl succinic anhydride [having a saponification number of 147, prepared from maleic anhydride and polyisobutene of number average molecular weight of 950 and having an average of 1.5 equivalents of succinic groups per alkenyl group]. To the reaction system is added 13.1 grams of tetraethylene pentaamine (0.5 equivalents). The system is heated and stirred at 160° C. for 3 hours. The reaction is then stopped and upon cooling to room temperature, 37 grams of ethylene carbonate (2 equivalents of ethylene carbonate per each basic nitrogen in the multiply adducted alkenyl succinimide) is added to the system. The system is heated and stirred at 160° C. for 4 hours. After cooling, a modified multiply adducted alkenyl succinimide is recovered.

EXAMPLE 38

Preparation of a $C_{18}$–$C_{30}$ Alkylphenol

To a 2-liter flask, equipped with stirrer, Dean Stark trap, condensor and nitrogen inlet and outlet was added 857 gms of a predominantly $C_{18}$ to $C_{30}$ olefin mixture (olefin content: $C_{16}$–0.5%; $C_{18}$–6.6; $C_{20}$–26.2%; $C_{22}$–27.7%; $C_{24}$–18.2%; $C_{26}$–9.0%; $C_{28}$–4.5%; $C_{30}$–28%; greater than $C_{30}$–4.5%) wherein in the entire olefin fraction, at least 30 mole percent of said olefins contain trisubstituted vinyl groups (available from Ethyl Corporation, Baton Rouge, La.), 720 gms phenol, 55 gms of a sulfonic acid cation exchange resin (polystyrene crosslinked with divinylbenzene) catalyst (Amberlyst 15 ® available from Rohm and Haas, Philadelphia, Pa.). The reaction mixture was heated to about 145° C. for about 6 hours with stirring under a nitrogen atmosphere. The reaction mixture was stripped by heating under vacuum and the resulting product filtered hot over diatomaceous earth to afford 947 gms of a $C_{18}$–$C_{30}$ alkylphenol with a hydroxyl number of 118 and 56% para-alkylphenol content.

EXAMPLE 39

Preparation of a $C_{20}$–$C_{28}$ Alkylphenol

To a 2-liter flask, equipped with stirrer, Dean Stark trap, condensor and nitrogen inlet and outlet was added 674 gms of a predominantly $C_{20}$ to $C_{28}$ olefin mixture (olefin content: $C_{18}$–2%; $C_{20}$–28%; $C_{22}$–19%; $C_{24}$–13%; $C_{26}$–21%; $C_{28}$–11%; and greater than $C_{30}$–6%) wherein in the entire olefin fraction at least 20 mole percent of said olefins contain vinylidine groups ($C_{20}$–$C_{24}$ olefins and $C_{24}$–$C_{28}$ olefins are available from Chevron Chemical Company, San Francisco, Calif. and are then physically mixed at an equal mole basis to provide a $C_{20}$–$C_{28}$ olefin mixture), 211.5 grams of phenol, 43 grams of a sulfonic acid cation exchange resin (polystyrene crosslinked with divinylbenzene) catalyst (Amberlyst 15 ® available from Rohm and Haas, Philadelphia, Pa.). The reaction mixture was heated to about 140° C. for about 8 hours with stirring under a nitrogen atmosphere. The reaction mixture was stripped by heating under vacuum and the product was filtered hot over diatomaceous earth to afford 574 grams of a $C_{20}$–$C_{28}$ alkylphenol with a hydroxyl number of 110 and with 56% para-alkylphenol content.

EXAMPLE 40

Preparation of Tetrapropenylphenol

To a 2-liter flask, equipped with stirrer, Dean-Stark trap, condensor, and nitrogen inlet and outlet was added 567 grams of tetrapropylene, 540 grams of phenol, 72 grams of a sulfonic acid cation exchange resin (polystyrene crosslinked with divinylbenzene) catalyst (Amberlyst 5 ® available from Rohm and Haas, Philadelphia, Pa.). The reaction mixture was heated to about 110° C. for about 3 hours with stirring under a nitrogen atmosphere. The reaction mixture was stripped by heating under vacuum and the resulting product filtered hot over diatomaceous earth to afford 626 grams of tetrapropenylphenol and with a hydroxyl number of 205 and with 96% para-alkylphenol content.

EXAMPLE 41

Into a 0.5-liter 3-neck flask, equipped with stirrer, Dean-Stark trap, condensor, and nitrogen inlet and outlet was charged 100 grams of phenol. The system was heated to 55° C. and then charged with 55 grams of $C_{24}$–$C_{28}$ olefin, available from Chevron Chemical Company, San Francisco, Calif., and 12.5 grams of Filtrol-13, an acid activated clay available from Filtrol Corporation, Los Angeles, Calif. Afterwards, 130.5 grams of $C_{18}$–$C_{30}$ olefin, available from Ethyl Corp., Baton Rouge, La., was added over 1 hour while heating the system from between 135° C. to 145° C. The reaction was stopped and filtered. The filtered produce was transferred to a clean flask, placed under vacuum (approximately 50 mm Hg) and heated to 215° C. with a small nitrogen sweep. The nitrogen was shut off and the vacuum (approximately 50 mm Hg) continued at 215° C. for 30 minutes to yield an alkylphenol having a hydroxyl number of 106.

EXAMPLE 42

Preparation of Calcium Overbased Hydrocarbyl Sulfonate

A. Preparation of Sodium Hydrocarbyl Sulfonate

Into a reaction vessel is charged 646 grams of feedstock (solvent refined 500N lubricating oil which is a mixture of alkyl aromatics, naphthenes and paraffins). At 75° F., 150.8 grams of oleum (approximately 27.6% $SO_3$) is charged to the reaction vessel over a 10-minute addition period. The reaction temperature is allowed to rise generally to about 100° F. Afterwards, 12.3 ml of water as well as 540 ml of Chevron 265 thinner, which is a mixture of aromatics, naphthenes and paraffins, is added to the system. The system is maintained at 150° F. for 1 hour. At this time, 125 ml of an aqueous solution containing 25% by weight sodium hydroxide is added to the system. The reaction is maintained at 150° F. for 1 hour. After settling, the aqueous layer is removed and the organic solution then is maintained for at least one hour. After this period, any additional aqueous layer which had settled out is also removed. The system is stripped at 350° F., atmospheric pressure with an air sweep to yield the sodium hydrocarbyl sulfonate which is purified as follows: The sodium hydrocarbyl sulfonate is dissolved in 330 ml of aqueous secondary butyl alcohol. 160 ml of an aqueous solution containing 4% by weight sodium chloride is added to the system. The system is heated to 150° F. and maintained at 150° F. for 2 hours. After settling, brine is removed. An additional 80 ml of an aqueous solution containing 4% by weight sodium chloride is added to the system. The system is heated to 150° F. and maintained at 150° F. for 1 hour. After settling, brine is removed. 220 ml of water is added to the system and the system heated to 150° F. The system is maintained at 150° F. for 1 hour. Afterwards, water and unsulfonated oil layer is removed leaving the aqueous secondary butyl alcohol solution containing the sodium hydrocarbyl sulfonate.

B. Preparation of Calcium Hydrocarbyl Sulfonate

To the aqueous secondary butyl alcohol solution containing the sodium hydrocarbyl sulfonate, produced as in A above, is added 550 ml of a solution containing water, secondary butyl alcohol and calcium chloride (approximately 10% $CaCl_2$). The system is heated to 150° F. and is maintained at 150° F. for 1 hour. After settling, brine is removed. 340 ml of water and 170 ml of an aqueous solution containing 40% by weight calcium chloride is added to the system. The system is heated to 150° F. and is maintained at 150° F. for at least 1 hour. After settling, brine is removed. 340 ml of water and 170 ml of an aqueous solution containing 40% by weight calcium chloride is added to the system. The system is heated to 150° F. and is maintained at 150° F. for at least 1 hour. After settling, brine is removed. 340 Ml of water is added to the system. The system is heated to 150° F. and is maintained at 150° F. for 1 hour. After settling, the aqueous layer is removed. An additional 340 ml of water is then added to the system. The system is heated to 150° F. and is maintained at 150° F. for 1 hour. After settling, the aqueous layer is removed. The aqueous secondary butyl alcohol solution is then stripped at elevated temperatures and reduced pressures to yield calcium hydrocarbyl sulfonate.

C. Preparation of Calcium Overbased Hydrocarbyl Sulfonate

Into a 500-ml 3-neck round bottom flask equipped with a mechanical stirrer, is added sufficient diluent oil to the calcium hydrocarbyl sulfonate, produced above, to yield 270 grams of a composition at 1.65% by weight calcium. 42.4 Grams water and 10.8 grams calcium hydroxide are added to the system. A reflux condensor is attached to one side neck and a thermometer is attached to the other side neck of the 3-neck round bottom flask. The system is heated to reflux (approximately 210° F.) and held there for at least one hour. The reaction system is then distilled by heating to a bottoms temperature of 330° F./atmospheric pressure. Afterwards, the temperature is raised to 400° F. under vacuum (approximately 20 mm Hg). The system is then cooled to 300° F. and the vacuum is discontinued. 20 Grams of diatomaceous earth is added to the product and the product filtered through a ¼-inch diatomaceous earth pad on a Buchner funnel, which is preheated prior to filtration to yield the title compound which is generally of approximately 16 Total Base Number.

EXAMPLE 43

Preparation of 340 TBN Calcium Overbased Sulfurized Alkylphenol

Into a 2-liter, 4-neck flask was charged 196 grams of tetrapropenylphenol, prepared in a manner similar to Example 40, 354 grams of $C_{18}$–$C_{30}$ alkylphenol, prepared in a manner similar to Example 38, 410 grams of decyl alcohol, 20 grams of 2-mercaptobenzothiazole, 40 grams of a calcium overbased hydrocarbyl sulfonate, prepared in a manner similar to Example 42 and 200 grams of Cit-Con 100N oil. The system was heated with agitation at 90° C. at which time 296 grams of $Ca(OH)_2$ and 108 grams of sulfur were charged to the reaction system. The reaction system was then held at 90° C. for 45 minutes. Afterwards, the reaction temperature was raised over a 15-minute period to 150° C. whereupon 206 grams ethylene glycol was added over a 60-minute period via an addition funnel. After complete addition of ethylene glycol, the reaction temperature was increased to 160° C. over a 15-minute period and held at this temperature for one hour. At this time, the stirring rate of the reaction mixture was increased to moderately fast, and the reaction temperature was then increased at a rate of 5° C. per 20 minutes until the reaction temperature reached 175° C. whereupon 144 grams of carbon dioxide was charged through a flowmeter to the reaction system over a 3-hour period. The reaction temperature was then increased to 195° C. and the system stripped under vacuum (approximately 10 mm of Hg) for a period of 30 minutes to yield 1269 grams of product which was purified by addition of 3 weight percent diatomaceous earth consisting of 50% Hi-Flo, and 50% of 512 Celite, commercial diatomaceous earth products available from Manville, Filtration and Minerals Division, Denver, Colo., followed by filtration through a ¼-inch Celite pad on a Buchner funnel. The resulting product has a Total Base Number of 340 (324 on second titrimeter); a viscosity of 720 centistokes at 100° C.; a sulfur content of 4.4 weight percent; and a calcium content of 12.3 weight percent.

EXAMPLE 44

Preparation of a 343 TBN Calcium Overbased Sulfurized Alkylphenol

Into a 10-gallon stainless steel reactor was charged 3.53 kilograms of tetrapropenylphenol, prepared in a manner similar to Example 40, 6.73 kilograms of $C_{18}$–$C_{30}$ alkylphenol, prepared in a manner similar to Example 38, 7.6 kilograms of decyl alcohol, 380 grams of 2-mercaptobenzothiazole, 760 grams of a calcium overbased hydrocarbyl sulfonate, prepared in a manner similar to Example 42 and 3.8 kilograms of Cit-Con 100N oil. The system was heated with agitation to 90° C. at which time 5.62 kilograms of $Ca(OH)_2$ and 2.05 kilograms sulfur were charged to the reaction system. The reaction system was then held at 90° C. for 45 minutes. Afterwards, the reaction temperature was raised over a 15-minute period to 150° C. whereupon 3.91 kilograms ethylene glycol was added over a 60-minute period via an addition flask. After complete addition of ethylene glycol, the reaction temperature was increased to 160° C. and held at this temperature for 1 hour. At this time, the stirring rate of the reaction mixture was increased and the reaction temperature was then increased at a rate of 5° C. per 20 minutes until the reaction temperature reached 175° C. whereupon 2.74 kilograms of $CO_2$ was charged to the reaction system over a 3-hour period. The reaction temperature was then increased to 195° C. and the system stripped under vacuum (approximately 10 mm of Hg) for a period of 30 minutes. The system was cooled overnight and then heated and agitated. The product was then purified by addition of 3 weight percent diatomaceous earth consisting of 50% Hi-Flo, and 50% of 512 Celite, commercial diatomaceous earth products available from Manville, Filtration and Minerals Division, Denver, Colo., followed by filtration to yield a product having a Total Base Number of 343 (324 on second titrimeter); a viscosity of 463 centistokes at 100° C.; a sulfur content of 4.4 weight percent, a calcium content of 12.4 weight percent and 1.6% crude sediment.

EXAMPLE 45

Into a 1-liter, 4-neck flask was added 99 grams of tetrapropenylphenol, prepared in a manner similar to Example 40, 167 grams of a $C_{20}$–$C_{28}$ alkylphenol, prepared in a manner similar to Example 39, 210 grams of decyl alcohol, 10 grams of 2-mercaptobenzothiazole, 20 grams of a calcium overbased hydrocarbyl sulfonate, prepared in a manner similar to Example 42 and 100 grams of Cit-Con 100N oil. The system was heated with agitation to 90° C. at which time 148 grams of Ca(OH)2 and 56 grams of sublimed sulfur were charged to the reaction system. The reaction was then held at 90° C. for 45 minutes. Afterwards, the reaction temperature was raised over a 15-minute period to 150° C. whereupon 103 grams of ethylene glycol was added over a 60-minute period. After complete addition of the ethylene glycol, the reaction temperature was increased to 160° C. and held at this temperature for 1 hour. At this time, the reaction temperature was increased at a rate of 5° C. per 20 minutes until the reaction temperature reached 175° C. whereupon 72 grams of carbon dioxide was charged to the reaction system over a 3-hour period. The reaction temperature was then increased to 195° C. and the system stripped under vacuum (approximately 10 mm of Hg) for a period of 30 minutes. Sediment was removed and 800 ml of 250 thinner which is a mixture of aromatics, paraffins and naphthenes was added to the system as well as 3 weight percent diatomaceous earth consisting of 50% Hi-Flo and 50% of 512 Celite, commercial diatomaceous earth products available from Manville, Filtration and Minerals Division, Denver, Colo. The system was filtered through a ¼-inch Celite pad on a Buchner funnel. Afterward, the thinner was removed by stripping at elevated temperatures and reduced pressures to yield 581 grams of a calcium overbased sulfurized alkylphenol having a Total Base Number of 328 (obtained from second titrimeter) a viscosity of 365 centistokes at 100° C.; a sulfur content of 3.9 weight percent; and a calcium content of 12.3 weight percent.

EXAMPLE 46

Into a 2-liter, 3-neck flask was added 332 grams of tetrapropenylphenol, prepared in a manner similar to Example 40, 200 grams of decyl alcohol and 36 grams of a calcium overbased hydrocarbyl sulfonate, prepared in a manner similar to Example 42. The system was heated to 70° C. at which time 168 grams of $Ca(OH)_2$ and 63 grams sulfur were charged to the reaction system. The system was then heated to 150° C. and over a 1-hour period 91 grams of ethylene glycol was added while collecting distillant in the overhead. Afterward, an additional 26 grams of decyl alcohol was added. The system was then heated to 170° C. and held there for one hour whereupon the system is heated to 180° C. and 52 grams of $CO_2$ added over about 2½ hours. 200 Grams of Cit-Con 100N oil was charged to the system and a vacuum (approximately 24mm/Hg) applied for a period of about 1/2 hour while collecting the overhead. Afterward, the vacuum was broken and an additional 180 grams of Cit-Con 100N oil was added to yield 910 grams of product. 510 Grams of this product was filtered through a 1/4 inch diatomaceous earth pad in a Buchner funnel. The resulting product has a Total Base Number of 253, a viscosity of 433 cSt at 100° C.; a sulfur content of 4.01 weight percent; and a calcium content of about 9.50 weight percent.

EXAMPLE 47

The compositions of this invention were tested in a Caterpillar 1-G2 test in which a single-cylinder diesel engine having a 5⅛" bore by 6½" stroke is operated under the following conditions: timing, degrees BTDC, 8; brake mean effective pressure, psi 141; brake horsepower 42; Btu's per minute 5850; speed 1800 RPM; air boost, 53" Hg absolute, air temperature in, 255° F.; water temperature out, 190° F.; and sulfur in fuel, 0.4%. At the end of each 12 hours of operation, sufficient oil is drained from the crankcase to allow addition of 1 quart of new oil. In the test on the lubricating oil compositions of this invention, the 1-G2 test is run for 240 hours. At the end of the noted time period, the engine is dismantled and rated for cleanliness. These results are reported below. Lower weight total demerits represent cleaner engines.

The tests were conducted employing four different formulations all of which used a Mid-Continent base stock SAE 30 oil containing 16 mmols/kg of a zinc dihydrocarbyl dithiophosphate and a sufficient amount of a viscosity index improver to give a 15W/40 oil.

Formulations A-1 and A-2 contained no added calcium overbased hydrocarbyl sulfonate whereas Formulations B-1 and B-2 contained 10 mmols/kg of a calcium overbased hydrocarbyl sulfonate similar to that prepared in Example 42. Formulations A-1 and B-1 used TLA-555® viscosity index improver which is a commercial viscosity index improver available from Texaco, Inc., White Plains, N.Y. Formulations A-2 and B-2 used Paratone 716® viscosity index improver available from Paramins Chemical Company. To these Formulations were added 8% of a succinimide so indicated in Table I and if present, mmols/kg of a calcium overbased sulfurized alkylphenol similar to that prepared in Example 46.

Table I below summarizes the results of this test:

TABLE I

| Formulation as Indicated Plus | Weighted Total Demerits For Formulation | | | |
|---|---|---|---|---|
| | A-1 | A-2 | B-1 | B-2 |
| Starting Succinimide of Example 4 | 350 | | | 445[a] |
| Starting Succinimide of Example 4 and calcium overbased sulfurized alkylphenol | | 303 | 360[b] | |
| Modified Succinimide similar to Example 4 | 598[b] | 536 | 545 | 366 |
| Modified Succinimide similar to Example 4 and calcium overbased sulfurized alkylphenol | 242 | 283 | 299 | 238 |

This data demonstrates the lack of adverse compatability for the combination of the instant invention as compared to prior art combinations.
All test results are one-run results except as noted.
[a]average of 3 runs
[b]average of 2 runs

[a] average of 3 runs
[b] average of 2 runs

This data demonstrates the lack of adverse compatability for the combination of the instant invention as compared to prior art combinations.

All test results are one-run results except as noted.

What is claimed is:

1. A lubricating oil composition comprising an oil of lubricating viscosity and (a) from about 0.2 to about 10 percent by weight of a polyamino alkenyl or alkyl succinimide wherein one or more of the nitrogens of the polyamino moiety is substituted with a hydroxyhydrocarbyl oxycarbonyl group wherein the hydroxyhydrocarbyl oxycarbonyl group contains from 2 to 20 carbon atoms and 1 to 6 hydroxy groups with the proviso that there is no hydroxy substitution on the hydrocarbyl carbon atom attaching the hydroxyhydrocarbyl group to the oxy atom of the oxycarbonyl group and with the further proviso that when more than one hydroxy group is contained in the hydroxyhydrocarbyl group, no more than one hydroxy is attached to the same carbon atom and the number of carbon atoms in the hydroxyhydrocarbyl group is minimally one greater than the number of hydroxy groups; and (b) from about 0.5 to about 40 percent by weight of a Group II metal overbased sulfurized alkylphenol.

2. A lubricating oil composition comprising an oil of lubricating viscosity and (a) from about 0.2 to about 10 percent by weight of a polyamino alkenyl or alkyl succinimide wherein one or more of the nitrogens of the polyamino moiety is substituted with a hydrocarbyl oxycarbonyl group; and (b) from about 0.5 to about 40 percent by weight of a Group II metal overbased sulfurized alkylphenol.

3. A lubricating oil composition comprising an oil of lubricating viscosity and (a) from 0.2 to 10 percent by weight of a polyamino alkenyl or alkyl succinimide wherein one or more of the nitrogens of the polyamino moiety is substituted with a hydroxy poly(oxyalkylene)oxycarbonyl group; and (b) from about 0.5 to about 40 percent by weight of a Group II metal overbased sulfurized alkylphenol.

4. A lubricating oil composition comprising an oil of lubricating viscosity and (a) from about 0.2 to about 10 percent by weight of a product produced by the process which comprises contacting at a temperature sufficient to cause reaction a polyamino alkenyl or alkyl succinimide containing at least one primary or secondary amine with a cyclic carbonate and wherein the molar charge of the cyclic carbonate to the basic nitrogen of the polyamino alkenyl or alkyl succinimide is from about 0.2:1 to about 10:1; and i0 from about 0.5 to about 40 percent by weight of a Group II metal overbased sulfurized alkylphenol.

5. A lubricating oil composition comprising an oil of lubricating viscosity and (a) from about 0.2 to about 10 percent by weight of a product produced by the process which comprises contacting at a temperature sufficient to cause reaction a polyamino alkenyl or alkyl succinimide containing at least one primary or secondary amine with a linear polycarbonate wherein the molar ratios of the individual carbonate units of said linear polycarbonate to the basic amine of the polyamino alkenyl or alkyl succinimide is from about 0.1:1 to about 5:1; and (b) from about 0.5 to about 40 percent by weight of a Group II metal overbased sulfurized alkylphenol.

6. A lubricating oil composition comprising an oil of lubricating viscosity and (a) from about 0.2 to about 10 percent by weight of a compound of the formula:

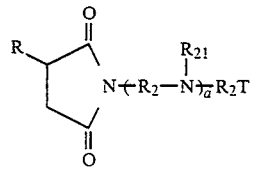

wherein R is alkenyl or alkyl of from 10 to 300 carbon atoms; $R_2$ is alkylene of from 2 to 10 carbon atoms; $R_{21}$ is hydrogen; lower alkyl of from 1 to 6 carbon atoms, lower hydroxy alkyl of from 1 to 6 carbon atoms,

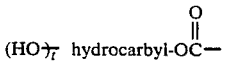

wherein t is an integer from 0 to 6, and hydrocarbyl is a hydrocarbyl group of from 2 to 20 carbon atoms; and

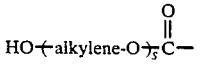

wherein alkylene-O is a $C_2$–$C_5$ oxyalkylene and s is an integer from 2 to 30; a is an integer of from 0 to 10; and T is $—NH_2$,

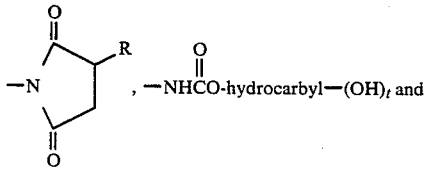

wherein R, hydrocarbyl, alkylene, s and t are as defined above; with the proviso that if T is $—NH_2$ or

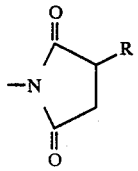

then a is not zero and at least one of $R_{21}$ is either

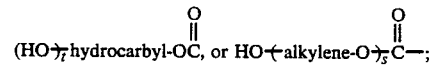

and (b) from about 0.5 to about 40 weight percent of a Group II metal overbased sulfurized alkylphenol.

7. A lubricating oil composition according to claim 6 wherein a is an integer from 1 to 6 and T is

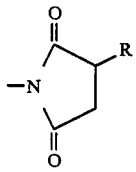

8. A method of improving the compatibility of a diesel engine lubricating oil composition containing about 0.5 to about 40 percent by weight of a Group II metal overbased sulfurized alkylphenol to a polyamino alkenyl or alkyl succinimide which comprises employing from about 0.2 to about 10 percent by weight of a modified polyamino alkenyl or alkyl succinimide selected from the group consisting of a polyamino alkenyl or alkyl succinimide wherein one or more of the nitrogens of the polyamino moiety is substituted with a hydroxyhydrocarbyl oxycarbonyl group wherein the hydroxyhydrocarbyl oxycarbonyl group contains from 2 to 20 carbon atoms and 1 to 6 hydroxy groups with the proviso that there is no hydroxy substitution on the hydrocarbyl carbon atoms attaching the hydroxyhydrocarbyl group to the oxy atom of the oxycarbonyl group and with the further proviso that when more than one hydroxy group is contained in the hydroxyhydrocarbyl group, no more than one hydroxy group is attached to the same carbon atom and the number of carbon atoms in the hydroxyhydrocarbyl group is minimally one greater than the number of hydroxy groups, a polyamino alkenyl or alkyl succinimide wherein one or more of the nitrogens of the polyamino moiety is substituted with a hydrocarbyl oxycarbonyl group, a polyamino alkenyl or alkyl succinimide wherein one or more of the nitrogens of the polyamino moiety is substituted with a hydroxy poly(oxyalklylene) oxycarbonyl group, a product produced by the process which comprises contacting at a temperature sufficient to cause reaction a polyamino alkenyl or alkyl succinimide containing at least one primary or secondary amine with a cyclic carbonate and wherein the molar charge of the cyclic carbonate to the basic nitrogen of the polyamino alkenyl or alkyl succinimide is from about 0.2:1 to about 10:1, and a product produced by the process which comprises contacting at a temperature sufficient to cause reaction a polyamino alkenyl or alkyl succinimide containing at least one primary or secondary amine with a linear polycarbonate wherein the molar ratios of the individual carbonate units of said linear polycarbonate to the basic amine of the polyamino alkenyl or alkyl succinimide is from about 0.1:1 to about 5:1.

9. A method of improving the compatability of a diesel engine lubricating oil composition containing about 0.5 to about 40 percent by weight of a Group II metal overbased sulfurized alkylphenol to a polyamino alkenyl or alkyl succinimide which comprises employing from about 0.2 to about 10 percent by weight of a compound of the formula:

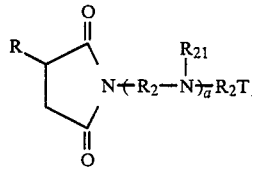

wherein R is alkenyl or alkyl of from 10 to 300 carbon atoms; $R_2$ is alkylene of from 2 to 10 carbon atoms; $R_{21}$ is hydrogen; lower alkyl of from 1 to 6 carbon atoms, lower hydroxy alkyl of from 1 to 6 carbon atoms,

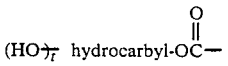

wherein t is an integer from 0 to 6, and hydrocarbyl is a hydrocarbyl group of from 2 to 20 carbon atoms; and

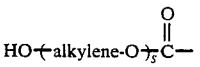

wherein alkylene-O is a $C_2$–$C_5$ oxyalkylene and s is an integer from 2 to 30; a is an integer of from 0 to 10; and T is $—NH_2$,

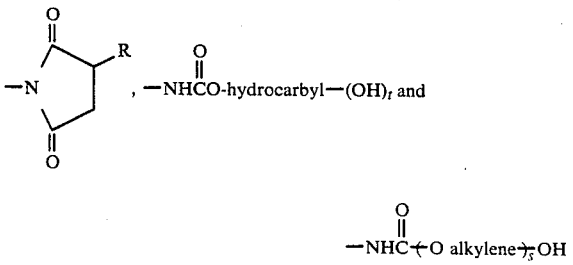

wherein R, hydrocarbyl, alkylene, s and t are as defined above; with the proviso that if T is $—NH_2$ or

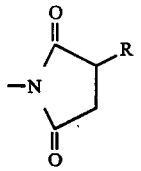
then a is not zero and at least one of $R_{21}$ is either
$$(HO)_t\text{hydrocarbyl-}\overset{\overset{\displaystyle O}{\|}}{C}O, \text{ or } HO(\text{alkylene-}O)_s\overset{\overset{\displaystyle O}{\|}}{C}-.$$
10. A method of claim 9 wherein a is an integer from 1 to 6 and T is
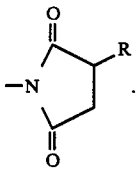
* * * * *